US007080885B2

(12) United States Patent
Bain et al.

(10) Patent No.: US 7,080,885 B2
(45) Date of Patent: Jul. 25, 2006

(54) TASK CHAIR

(75) Inventors: Charles E. Bain, West Dundee, IL (US); Jeffrey A. Kennedy, Algonquin, IL (US)

(73) Assignee: Kerr Corporation, Orange, CA (US)

( * ) Notice: Subject to any disclaimer, the term of this patent is extended or adjusted under 35 U.S.C. 154(b) by 0 days.

(21) Appl. No.: 10/990,656

(22) Filed: Nov. 17, 2004

(65) Prior Publication Data

US 2005/0104435 A1 May 19, 2005

Related U.S. Application Data

(60) Provisional application No. 60/520,859, filed on Nov. 18, 2003.

(51) Int. Cl.
*B60N 2/24* (2006.01)

(52) U.S. Cl. ..... 297/354.1; 297/353; 297/411.25; 297/411.35

(58) Field of Classification Search ..... 297/354.1, 297/353, 411.25, 411.35, 411.36, 411.37; 248/282.1, 285.1, 284.1, 286.1, 118.3, 118.5
See application file for complete search history.

(56) References Cited

U.S. PATENT DOCUMENTS

| | | | | |
|---|---|---|---|---|
| 4,239,282 A | | 12/1980 | White | 297/284 |
| 4,466,664 A | | 8/1984 | Kondou | 297/411 |
| 4,541,670 A | | 9/1985 | Morgenstern et al. | 297/284 |
| 4,790,600 A | | 12/1988 | Behringer | 297/337 |
| 4,807,935 A | | 2/1989 | King | 297/417 |
| 5,009,467 A | | 4/1991 | McCoy | 297/411 |
| 5,171,317 A | * | 12/1992 | Corcoran | 606/241 |
| 5,369,805 A | * | 12/1994 | Bergsten et al. | 297/411.35 |
| 5,380,065 A | * | 1/1995 | Rohrer | 297/411.37 |
| D368,380 S | | 4/1996 | Olson et al. | D6/366 |
| 5,542,743 A | | 8/1996 | Olson et al. | 297/353 |
| 5,651,586 A | * | 7/1997 | Groth | 297/411.37 |
| 6,003,940 A | | 12/1999 | Jackson | 297/217.3 |
| 6,074,012 A | | 6/2000 | Wu | 297/411.26 |
| 6,189,971 B1 | | 2/2001 | Witzig | 297/284.11 |
| 6,203,109 B1 | | 3/2001 | Bergsten et al. | 297/41.35 |
| 6,619,747 B1 | * | 9/2003 | Ko et al. | 297/423.12 |

FOREIGN PATENT DOCUMENTS

| | | |
|---|---|---|
| GB | 1 321 193 | 6/1973 |
| WO | WO 89/O9557 | 10/1989 |

* cited by examiner

*Primary Examiner*—Laurie K. Cranmer
(74) *Attorney, Agent, or Firm*—Wood, Herron & Evans, L.L.P.

(57) ABSTRACT

A task chair equipped with a mechanism for independently adjusting the height and width of support arms by the manual operation of a single adjustment knob. Each of the support arms includes a first arm portion and a second arm portion that are pivotally coupled by corresponding pivot joints. Each second arm portion carries one of a pair of arm pads. Each second arm portion may be inclined relative to the corresponding first arm portion for inclining the corresponding arm pad relative to a seat plate of the task chair. Each arm pad is joined with the corresponding second arm portion by a coupling mechanism that permits movement of each arm pad with two degrees of translational freedom and one degree of rotational freedom.

23 Claims, 17 Drawing Sheets

TASK CHAIR

CROSS-REFERENCE TO RELATED APPLICATIONS

This application claims the benefit of U.S. Provisional Application No. 60/520,859 filed on Nov. 18, 2003, and the disclosure of which is hereby incorporated by reference herein in its entirety.

FIELD OF THE INVENTION

The invention relates generally to chairs, and in particular, to a task chair having position-adjustable support arms.

BACKGROUND OF THE INVENTION

Task chairs are familiar items of furniture commonly used in an office or other occupational environment by persons while working in a seated position. Traditionally, producing a task chair suitable for a broad spectrum of individuals is a difficult endeavor. A primary reason for this difficulty encountered by task chair manufacturers is that users of task chairs vary greatly in their body shape, relative physical size and proportions.

To enhance comfort, manufacturers create task chairs characterized by a high degree of adjustability so that the task chair can be conformed to the body shape, physical size, and proportions of a seated chair user. Most task chairs incorporate manual adjustment features that allow the seated chair user to adjust the shape or movement characteristics of the chair components to a desired configuration. In particular, most task chairs have support arms with rests or pads upon which a person seated in the chair may support or prop their forearms. Seated chair users may need to adjust the position of the pads to customize them after initial assembly of the task chair.

The support arms are adjustable with at least one degree of freedom, such as a vertical height adjustment, for altering the position of the rests relative to the chair seat. In addition, the width between the arm pads may be adjusted by changing the relative position of the two support arms. Traditionally, separate adjustment knobs located on each arm have controlled these two basic movements. As a result, four individual adjustment knobs are required.

Adjustment knobs are prone to snagging power cables and/or vacuum lines attached to medical equipment in use by a user seated in the task chair, which may damage the equipment, the cables and/or the lines or may simply result in an unintentional disconnection. In addition, power cables and vacuum lines may wind about the adjustment knobs during use so that the length is effectively reduced. The likelihood for a seated user to experience such difficulties increases with an increase in the number of adjustment knobs.

What is needed, therefore, is a task chair that addresses these and other deficiencies of conventional task chairs.

SUMMARY

In an embodiment of the present invention, a task chair includes a seat plate, a spine projecting upward from the seat plate, a carriage mounted for movement relative to the spine, and a pair of spaced-apart support arms supported by the carriage. The support arms flank the seat plate and are separated vertically from the seat plate. The task chair further includes first and second adjustment mechanisms coupled with the carriage and an adjustment element operatively coupled with the first and second adjustment mechanisms. The first adjustment mechanism is operative for moving the carriage relative to the spine to move the support arms up and down relative to the seat plate. The second adjustment mechanism is operative for moving the support arms laterally relative to the seat plate. The adjustment element is adapted to independently operate the first and the second adjustment mechanisms.

In another embodiment of the present invention, a task chair includes a support pedestal with a seat plate, a spine projecting upwardly from the seat plate, and a pair of spaced-apart support arms supported by the spine. The support arms flank the seat plate in a plane separated vertically from the seat plate. Each of the support arms includes a first arm portion coupled with the spine, a second arm portion, and a pivot joint rotatably coupling the first and second arm portions. The pivot joint allows the second arm portion to be inclined relative to the corresponding first arm portion for adjusting the inclination of the second arm portion relative to the seat plate.

In yet another embodiment of the present invention, a task chair includes a seat plate, a spine projecting upwardly from the seat plate, and a pair of spaced-apart support arms supported by the spine. The support arms, which flank the seat plate, are separated vertically from the seat plate. The task chair further includes a pair of pad slides each carrying an arm pad, and a pair of adjustment mechanisms each coupling a corresponding one of the pad slides with a corresponding one of the support arms. Each of the adjustment mechanisms has a first member mounted to the corresponding one of the support arms for movement in a first direction in a plane, and a second member mounted for rotation to the first member about an axis of rotation normal to the plane. The second member carries the corresponding one of the pad slides so that the pad slide rotates simultaneously with the second member.

The task chair includes a clean appearance achieved by replacing the traditional multiple arm pad adjustment knobs with a single adjustment arm pad adjustment knob. In addition, the clean appearance is promoted by locating the single adjustment knob at the rear of the task chair. A user seated in the task chair of the invention may easily manipulate medical equipment without concerns about power cables and/or vacuum lines snagging or winding about traditional adjustment knobs. The design of the task chair of the present invention is simplified as two directions of travel or degrees of freedom of the arm pads are adjusted by a single knob. The task chair further includes a system that allows the arm pads to be translated with at least one degree of linear freedom and rotated relative to the support arms to which they are attached. The task chair of the present invention is adaptable to a wide range of work place requirements while maintaining ergonomically correct comfort for a seated user. The task chair can adjust the support arms to accommodate a wide range of body shapes, physical sizes, and proportions of a seated chair user.

BRIEF DESCRIPTION OF THE FIGURES

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE PREFERRED EMBODIMENTS

References herein to terms such as "vertical", "horizontal", etc. are made by way of example, and not by way of limitation, to establish a frame of reference. Terms, such as "anterior", "posterior", "on", "above", "below", "under", "upper", "lower", "over", "beneath", "right", "left", "rear", and "front" are defined with respect to a person seated in the task chair. It is understood various other frames of reference may be employed for purposed of describing the task chair without departing from the spirit and scope of the invention.

Figure 1:
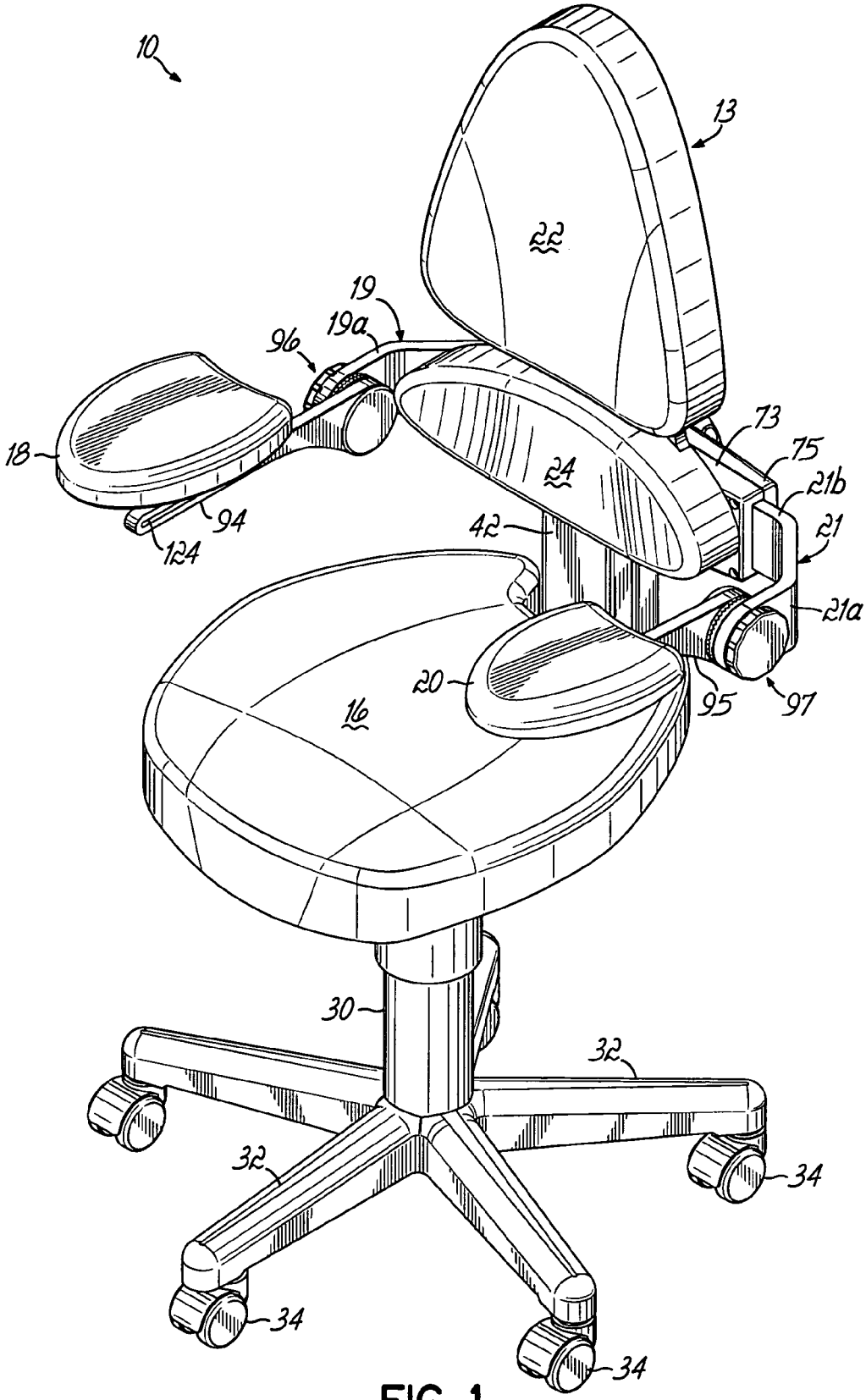
FIG. 1 is a front perspective view of a task chair in accordance with an embodiment of the present invention.
Figure 2:
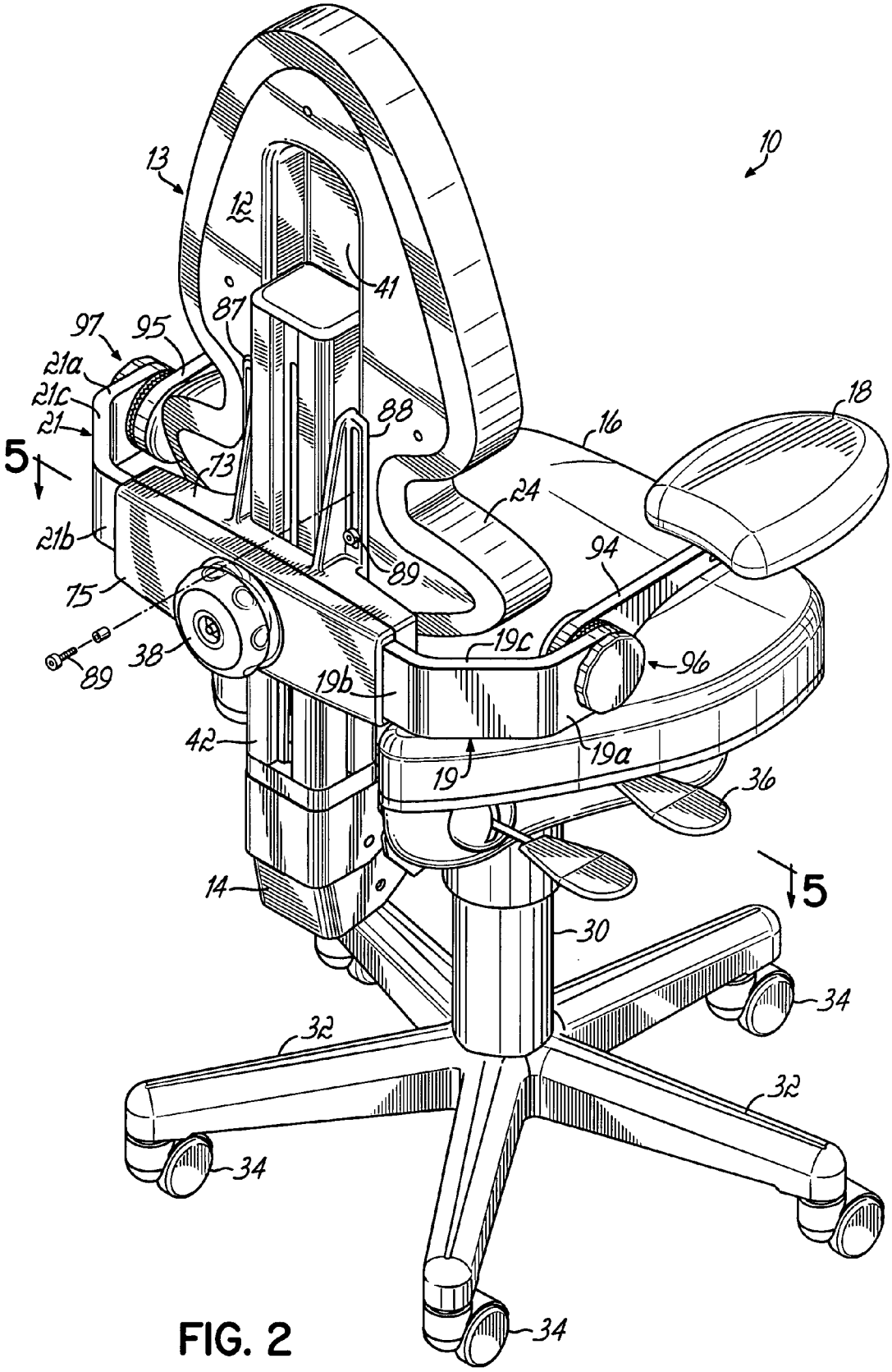
FIG. 2 is a rear perspective view of a task chair in accordance with an embodiment of the present invention.

With reference to FIGS. 1 and 2, a task chair, constructed in accordance with the present invention, is designated generally by the reference numeral 10. Task chair 10 includes a seat cushion 16 and arm pads 18, 20 situated near the free ends of respective support arms 19, 21. Task chair 10 further includes a back assembly, generally indicated by reference numeral 13, with a back cushion 22, a lumbar pad 24, and a back support member 12 to which the back cushion 22 and the lumbar pad 24 are attached. The arm pads 18, 20, seat cushion 16, back cushion 22, and lumbar pad 24 may each consist of a layer of foam padding covered by a suitable decorative fabric or upholstery material. A seat support member or seat plate 26 (FIG. 3A), upon which seat cushion 16 is supported, is positioned atop a vertical support pedestal 30. The seat cushion 16 is mounted with conventional fasteners to mounting holes defined in flanges 23 (FIG. 3A) of seat plate 26.

A plurality of legs 32 extends radially outward at a shallow angle from a base of vertical support pedestal 30 to define a rigid and stable chair support. Each leg 32 is fitted with a castor 34 so that the chair 10 can be rolled on the castors 34 about the work space environment. Flat floor pads, however, could replace the castors 34. Located within the vertical support pedestal 30 is a height-adjustable mechanism (not shown), such as a pneumatic cylinder, actuated by an actuation lever 36 for telescopically extending a center post relative to a center hub. A seated individual can operate actuation lever 36 for varying the length of the vertical support pedestal 30 and, hence, raising and lowering the height of the seat plate 26 and seat cushion 16 above the floor. A back frame (not shown), to which the back cushion 22 and lumbar pad 24 are attached, is carried vertically as the height of the seat plate 26 is changed.

Support arm 19 includes two arm portions 19*a*, 19*b* that are joined by an angled corner portion 19*c*. Similarly, support arm 21 includes two arm portions 21*a*, 21*b* that are also joined by an angled corner portion 21*c*. The angled corners 19*c*, 21*c* serve to reduce the space occupied by the support arms 19, 21. Arm portions 19*a*, 21*a* flank the seat plate 26 and are transversely spaced apart generally in an overlying plane spaced above the seat plate 26.

Figure 3B:
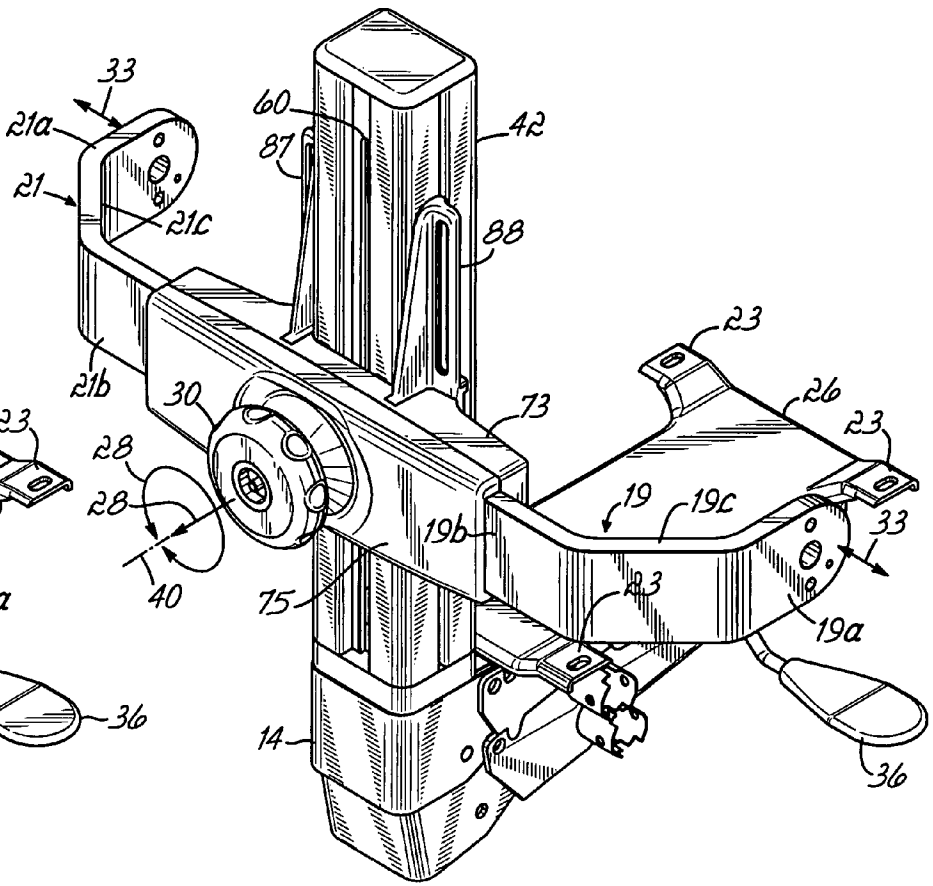
FIG. 3B is a rear perspective view similar to FIG. 3A illustrating use of the dual-axis arm adjustment system for changing the separation between the portions of the support arms flanking the seat plate.
Figure 3A:
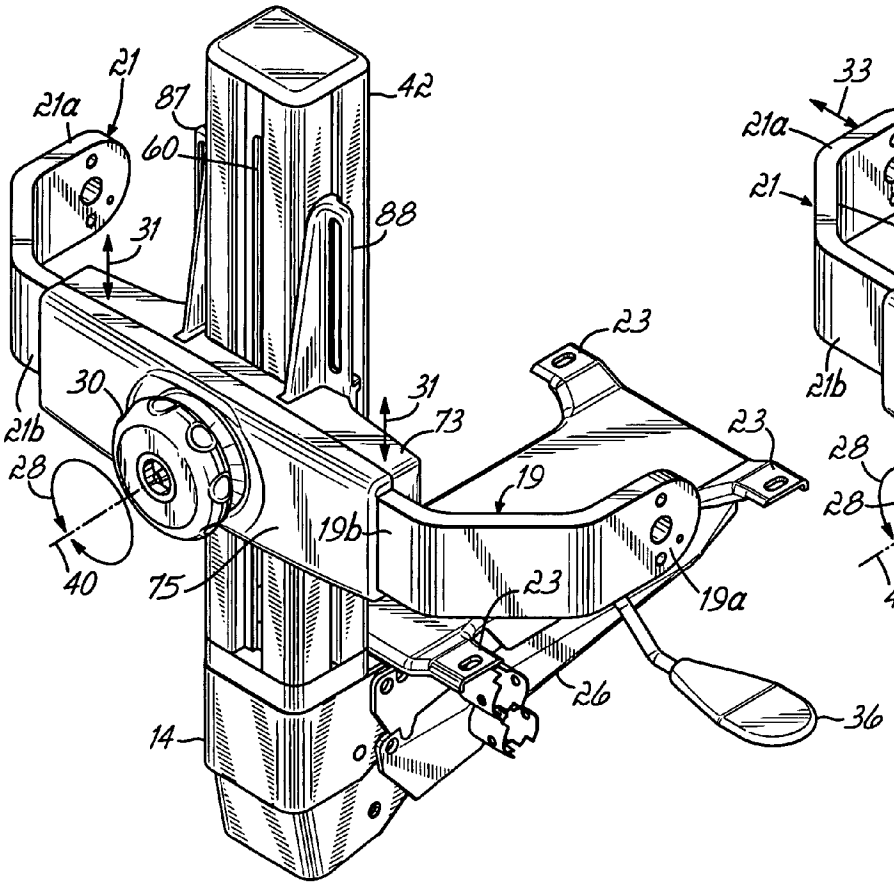
FIG. 3A is a rear perspective view of a portion of the task chair of FIG. 2, shown with various components removed for clarity, illustrating use of the dual-axis arm adjustment system for changing the height of the support arms relative to the seat plate.

With reference to FIGS. 3A and 3B, task chair 10 includes a dual-axis arm adjustment system for simultaneously adjusting the vertical (travel height or up-down) position of the support arms 19, 21 and arm pads 18, 20 relative to the seat plate 26, as best shown in FIG. 3A. The dual-axis arm adjustment system also adjusts the lateral (width or left-right) position of the arm pads 18, 20 relative to one another by laterally repositioning the support arms 19, 21, as best shown in FIG. 3B. These two adjustments are accomplished with a single adjustment knob 38, which supplies the user interface for both movement and locking functions for travel height adjustment and for width adjustment.

The adjustment knob 38 is bi-directionally rotatable about a central axis 40, as indicated by double-headed arrow 28, and is inwardly/outwardly (e.g., anteriorly/posteriorly) movable in an axial direction parallel to the central axis 40. Turning the knob 38 in one angular sense or direction (e.g., clockwise as viewed from the posterior of task chair 10) raises the height of both of the support arms 19, 21 relative to the seat plate 26 and, hence, the height of the arm pads 18, 20 relative to the seat plate 26. Turning knob 38 in the opposite angular sense or direction (e.g., counterclockwise as viewed from the posterior of task chair 10) lowers the height of the support arms 19, 21 and associated arm pads 18, 20 relative to the seat cushion 16. The vertical adjustability of the support arms 19, 21 is indicated by double-headed arrows 31 on FIG. 3A.

The adjustment knob 38 is normally biased in an anterior direction so that varying the vertical position or height of the support arms 19, 21 relative to the seat plate 26 is the default mode of operation. However, the adjustment knob 38 is movable in an outward (i.e., posterior) direction along central axis 40 for engaging the components of the dual-axis arm adjustment system that adjust the separation between the support arm portions 19*a*, 21*a*. If the adjustment knob 38 is moved posteriorly and rotated, rotation in one angular direction or sense (e.g., clockwise) widens the distance between the support arm portions 19*a*, 21*a*, and rotation in the opposite angular direction or sense (e.g., counterclockwise) narrows the distance between support arm portions 19*a*, 21*a*, as indicated by double-headed arrows 33 in FIG. 3A. After the width adjustment is completed and the force applied to the adjustment knob 38 in the posterior direction is removed, the released adjustment knob 38 is spring biased in an anterior direction toward the front of the task chair 10. The width adjustment is only operational while the adjustment knob 38 is pulled in the posterior direction.

Figure 4:
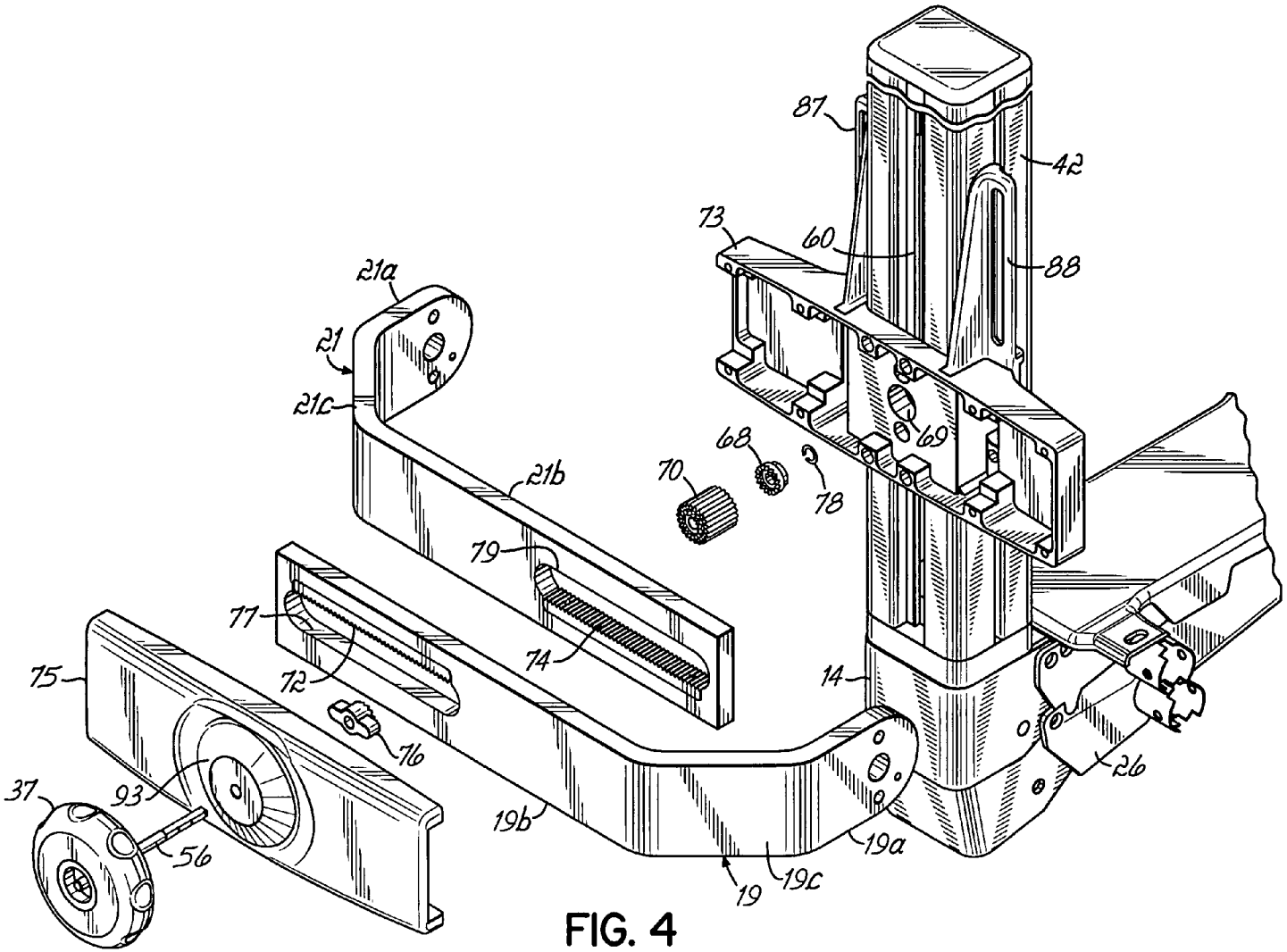
FIG. 4 is an exploded view of a portion of the dual-axis arm adjustment system of the task chair of FIG. 1.
Figure 4A:
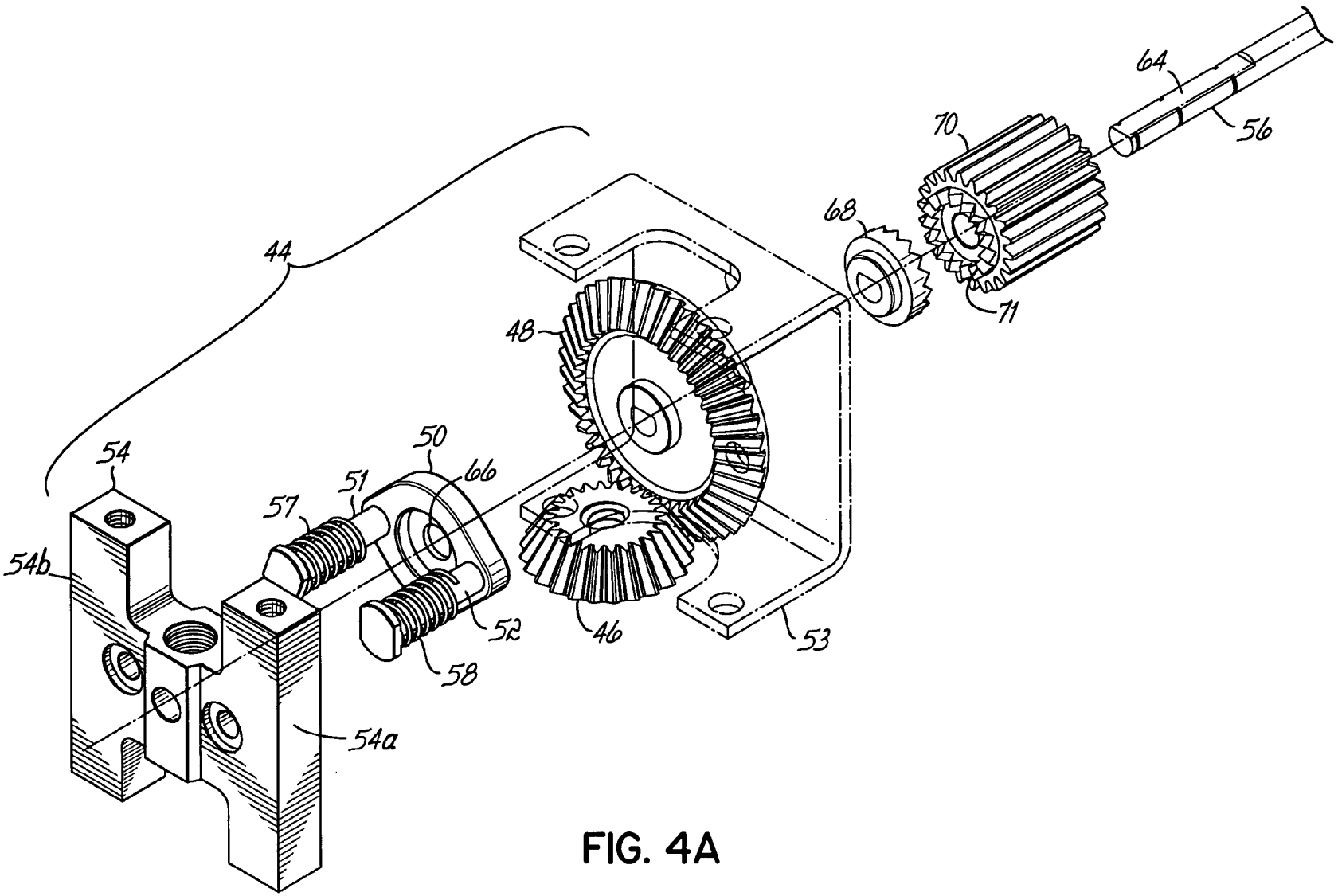
FIG. 4A is an exploded view of another portion of the dual-axis arm adjustment system of the task chair of FIG. 1.

With reference to FIGS. 3A, 4A, 5, and 5A, the components of the dual-axis arm adjustment system for raising and lowering the height of the support arms 19, 21 and associated arm pads 18, 20 relative to the seat plate 26 will be described. Projecting upwardly from the rear of the seat plate 26 is a tubular spine 42 that mounts the dual-axis arm adjustment system to the seat plate 26. Spine 42 is coupled pivotally with seat plate 26 by a spine mount 14. Disposed inside a hollow interior channel 43 (FIGS. 5, 5A) of the spine 42 is a carriage or yoke assembly, generally indicated by reference numeral 44 (FIG. 4). Yoke assembly 44 is adapted to move vertically relative to spine 42, as indicated generally by the double-headed arrow 45 (FIG. 5), and carries the support arms 19, 21 for vertical movement upwardly and downwardly relative to the seat plate 26.

The yoke assembly 44 includes a bevel pinion 46, a bevel gear 48, a bevel yoke 50, a pair of yoke pins 51, 52, a support bracket 53, a yoke support 54, a knob shaft 56, and a pair of biasing members 57, 58 illustrated as coil compression springs. The bevel pinion 46 and bevel gear 48 operate as driven and driver gears, respectively, so that rotation of bevel gear 48 drives rotation of bevel pinion 46. Each of the biasing members 57, 58 is captured in a compressed condition between a head of one of the yoke pins 51, 52 and a centering recess defined in a side surface of yoke support 54. A threaded tip of each of the yoke pins 51, 52 is engaged with a corresponding one of a pair of threaded bolt holes defined in the bevel yoke 50. The support bracket 53 is joined with the H-shaped yoke support 54 by registering clearance openings defined in projecting arms of support bracket 53 with threaded openings defined on the top and bottom of each of the parallel side legs of the yoke support 54 and securing the support bracket 53 to the yoke support 54 with conventional fasteners.

Adjustment knob 38 is physically coupled with an exposed end 56*a* of knob shaft 56 to define an adjustment element for the dual-axis arm adjustment system. Bevel gear 48 and bevel yoke 50 are retained at an opposite end of the knob shaft 56 from the adjustment knob 38 by a pair of retaining clips 47, 49 engaged in corresponding circumferential grooves defined in knob shaft 56. A flat 64 on knob shaft 56 contacts a corresponding flat (not shown) defined inside the D-shaped hub opening of bevel gear 48, which operates as a key and keyway that constrain bevel gear 48 and knob shaft 56 to rotate with a common angular velocity. Gear teeth on the bevel gear 48 are meshed with gear teeth on the bevel pinion 46 when the adjustment knob 38 is in its normal position.

The adjustment knob 38 is biased in an anterior direction by the compressed biasing members 57, 58, which operate to maintain the adjustment knob 38 in its normal position unless a posterior-directed force sufficient to overcome the spring bias of biasing members 57, 58 is deliberately applied to the adjustment knob 38. A manual rotational force transferred from the adjustment knob 38 to the bevel gear 48 by rotation of the knob shaft 56, with the posterior-directed force applied, causes bevel gear 48 to drive rotation of bevel pinion 46. The biasing members 57, 58 may be replaced by other conventional spring biasing constructions. For example, a single coil spring may be positioned in a slot 67 defined in rear arm housing 75 with a coaxial relationship about the knob shaft 56 and compressed between coupling 76 and a portion of rear arm housing 75.

A closed-ended vertical slot 60 (FIG. 4) extending through the posterior of the spine 42 limits the travel of the yoke assembly 44 vertically by defining upper and lower travel limits for the knob shaft 56, which protrudes from the interior channel 43 through slot 60. Running the vertical length of the spine 42 is a lead screw 62 having a threaded engagement with a threaded bore of bevel pinion 46. The yoke assembly 44 travels vertically within the spine 42 in response to the rotation of bevel pinion 46. The yoke assembly 44 either ascends or descends on the fixed-position lead screw 62, depending on the direction of manual rotation of adjustment knob 38. The bevel pinion 46 and bevel gear 48 cooperate to transmit motion between the non-parallel knob shaft 56 and lead screw 62.

The yoke pins 51, 52, which pass through corresponding clearance holes defined in the yoke support 54, thread into the bevel yoke 50 for trapping the biasing members 57, 58 on the posterior face of the yoke support 54. The spring force applied by the biasing members 57, 58 resiliently biases the bevel gear 48 into mesh with the bevel pinion 46. The bevel yoke 50 supports the posterior end of the knob shaft 56 via the yoke pins 51, 52, and yoke support 54. The bevel yoke 50 also furnishes a bearing surface for the posterior face of the bevel gear 48. The bevel yoke 50 maintains its radial alignment with the yoke support 54 via the yoke pins 51, 52 and axially on the knob shaft 56. The posterior end of the knob shaft 56 rotates freely within a circular central opening 66 of the bevel yoke 50, which is coaxial with the D-shaped opening in the hub of the bevel gear 48. Hence, the position of bevel yoke 50 remains fixed relative to the knob shaft 56 as the knob shaft 56 rotates.

The support arms 19, 21 and respective arm pads 18, 20 are raised and lowered, along with yoke assembly 44, relative to the seat plate 26. As the yoke assembly 44 moves vertically, the back support member 12 moves relative to the spine 42 because the yoke assembly 44 and back support member 12 are both secured with the rear housing 73. The spine 42 is positioned partially in, or inset within, a vertical channel 41 defined in the back support member 12. Recessing the spine 42 in the vertical channel 41 allows the overall footprint of the task chair 10 to be minimized.

With reference to FIGS. 3B, 4, 4A, 6, and 6A, the components of the dual-axis arm adjustment system for adjusting the separation between the support arms 19, 21 and associated arm pads 18, 20 will be described. As mentioned above, knob shaft 56 is movable in a posterior direction by a posteriorly-directed force applied to adjustment knob 38 of a magnitude sufficient to overcome the spring bias applied by biasing members 57, 58. A coupling 68 is mounted on knob shaft 56 with a fixed angular orientation as the hub of coupling 68 has a D-shaped profile that is secured against rotation by contact with flat 64 on knob shaft 56. Coupling 68 resides in a cylindrical concavity 69 defined inside the front arm housing 75. This concavity 69 is positioned inside the vertical slot 60 defined in spine 42 and assists in guiding the vertical movement of the rear and front housings 73, 75, the yoke assembly 44, and the support arms 19, 21. Another coupling 71 is mechanically coupled with an arm drive gear 70, which is also mounted for rotation along with coupling 71 about knob shaft 56, and includes a series of depressions and projections that confront complementary depressions and projections of coupling 68.

Posterior movement of knob shaft 56 moves the depressions and projections of coupling 68 into a meshed mechanically-coupled driving engagement with the depressions and projections of coupling 71. When the couplings 68, 71 are meshed and locked, the relative separation between arm portions 19*a*, 21*a* of support arms 19, 21, respectively, is adjustable by rotation of the knob shaft 56. The lateral adjustment of the relative separation between arm portions 19*a*, 21*a* adjusts the distance between the arm pads 18, 20 (e.g., wider apart or closer together).

The posterior movement of the adjustment knob 38 and knob shaft 56 also moves bevel gear 48 in a posterior direction, which disengages bevel gear 48 from bevel pinion 46. As a result, the yoke assembly 44 and the height of the arm pads 18, 20 is undisturbed by rotation of the adjustment knob 38 when the adjustment knob 38 is displaced posteriorly. In other words, the yoke assembly 44 is uncoupled mechanically from rotation of the adjustment knob 38 and knob shaft 56 and, as a result, the height adjustment of the support arms 19, 21. The posterior movement of the adjustment knob 38 also further compresses the biasing members 57, 58 to provide a spring return when the axial force is removed from the adjustment knob 38. Contact between the bevel gear 48 and bevel pinion 46 acts as a stop for the spring return as the knob shaft 56 moves axially after the axial force is removed from the adjustment knob 38.

Arm portions 19*b*, 21*b* are positioned side-by-side inside assembled arm housings 73, 75. An arm rack 72 is fastened with conventional fasteners inside a recess of a closed contoured slot 77 (FIG. 4) defined in arm portion 19*b* of support arm 19. Similarly, an arm rack 74 is fastened with conventional fasteners inside a recess of a closed contoured slot 79 (FIG. 4) defined in arm portion 21*b* of support arm 21. The arm portions 19*b*, 21*b* are arranged such that the slots 77, 79 are adjacent and a portion of arm drive gear 70 is disposed within each of the slots 77, 79. Teeth formed on the arm rack 72 are disposed in meshing engagement with an upper toothed portion of the arm drive gear 70. Similarly, teeth formed on the arm rack 74 are disposed in meshing engagement with a lower toothed portion of the arm drive gear 70. The arm housings 73, 75 serve to operatively interrelate and couple the arm portions 19*b*, 21*b* and the arm drive gear 71.

When the adjustment knob 38 is maintained in the withdrawn posterior state and manually rotated, arm drive gear 70 concurrently moves arm racks 72, 74 in opposite directions as the meshed engagement between the arm racks 72, 74 and the arm drive gear 70 converts rotation of adjustment knob 38 into linear motion. The anti-parallel relative movement of arm portions 19*b*, 21*b* causes the arm portions 19*a*, 21*a* of support arms 19, 21 and, hence, arm pads 18, 20, to spread apart or move closer together depending on the direction of rotation. The depressions and projections of racks 72, 74 have the same pitch so that rotation of arm drive gear 70 simultaneously moves the arm portions 19*b*, 21*b* over equal linear distances and, consequently, changes the distance between arm portions 19*a*, 21*a* symmetrically relative to the seat plate 26.

The support arm portions 19*a*, 21*a* may be positioned in any one of a continuum of width states between maximum and minimum widths by applying an axial force against the spring bias of biasing members 57, 59 to activate the width-adjustment mechanism and then rotating the adjustment knob 38 in one direction or the other. When viewed from the posterior or rear of the task chair 10 and in one embodiment of the invention, a clockwise rotation of the adjustment knob 38, with knob 38 withdrawn axially in the posterior direction advances, the support arm portions 19*a*, 21*a* laterally away from each other, which widens the distance between the arm pads 18, 20. Counterclockwise rotation of the adjustment knob 38 moves the support arm portions 19*a*, 21*a* closer together, which narrows the separation between the arm pads 18, 20.

Arm drive gear 70 is secured to the D-shaped end 64 of knob shaft 56 by a D-shaped hub opening such that arm engagement gear 70 rotates with the same angular velocity as knob shaft 56. The knob shaft 56 projects through a clearance hub opening in a coupling 76, which is secured to knob shaft 56 between a retaining clip 78 and a collar 80 projecting radially outward from the knob shaft 56. The arm drive gear 70 is held in position by surface contact with the front and rear arm housings 73, 75, which keeps gear 70 centered and in a position suitable for engaging arm racks 72, 74. Posterior movement of knob shaft 56 moves the depressions and projections of coupling 68 into a meshed mechanically-coupled driving engagement with the depressions and projections of coupling 71, which couples the knob shaft 56 with arm drive gear 70.

When the knob shaft 56 is moved posteriorly by a pull force directed in a posterior direction, the depressions and projections of couplings 68 and 71 are engaged. When the posterior force is removed from the adjustment knob 38, the knob shaft 56 retracts in an anterior direction under the influence of the spring bias applied by the biasing members 57, 58. Couplings 68 and 71 are disengaged so that rotation of the knob shaft 56 does not rotate the arm drive gear 70. In the retracted position shown in FIGS. 5 and 5A, a series of depressions and projections extending about a perimeter of a coupling 76 mesh with confronting a series of depressions and projections extending about a perimeter of a coupling 63 that is associated with arm drive gear 70. The engagement between couplings 63 and 76 secures the arm drive gear 70 against rotation by as the oppositely-projecting ears of coupling 76 are constrained by the sidewalls of the slot 67 defined in rear arm housing 75. Hence, the support arms 19, 21 are positively locked against lateral movement unless a posterior force of a sufficient magnitude is applied to the adjustment knob 38.

As a result, the width adjustment is independent of the height adjustment. The height-adjustment mechanism provided by yoke assembly 44 (FIG. 4A) is deactivated by disengaging the bevel gear 48 from the bevel pinion 46 so that arm width adjustment neither interferes with, nor disturbs, the existing arm height setting. For similar reasons and as explained above, arm height adjustment does not interfere with, or disturb, the existing arm width setting.

Figure 5:
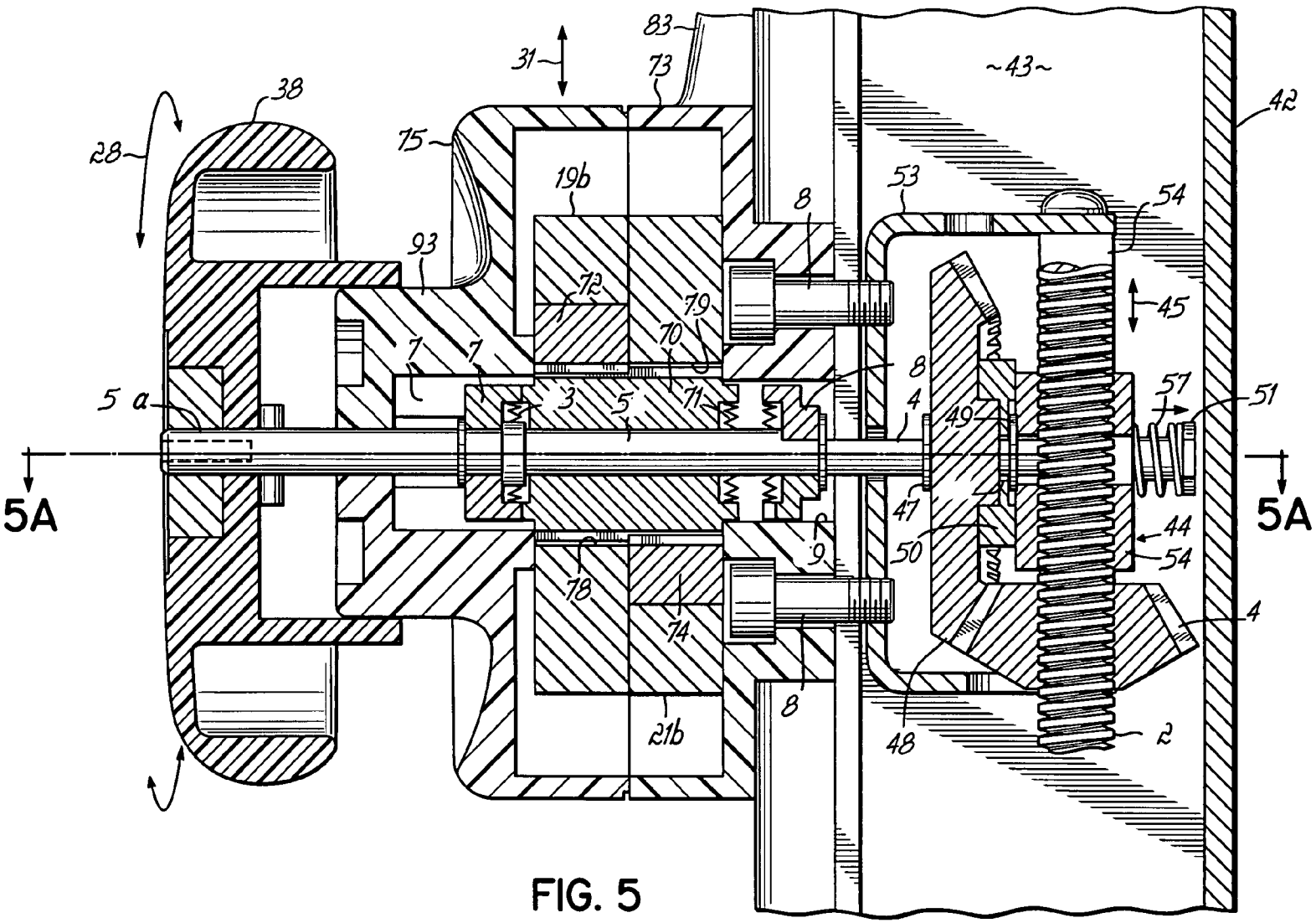
FIG. 5 is a cross-sectional view taken generally along line 5—5 in FIG. 2.
Figure 5A:
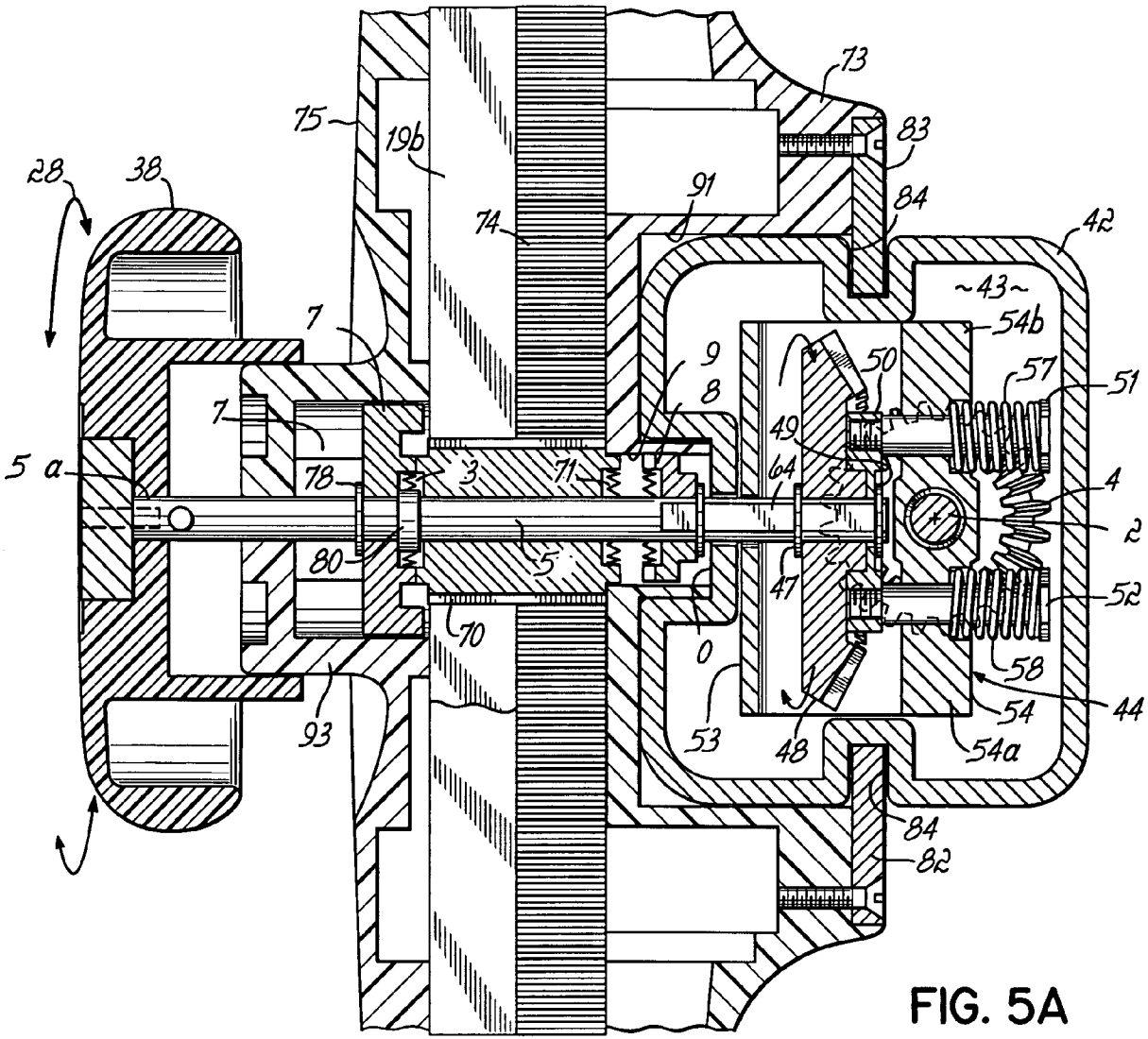
FIG. 5A is a cross-sectional view taken generally along line 5A—5A in FIG. 5.
Figure 6:
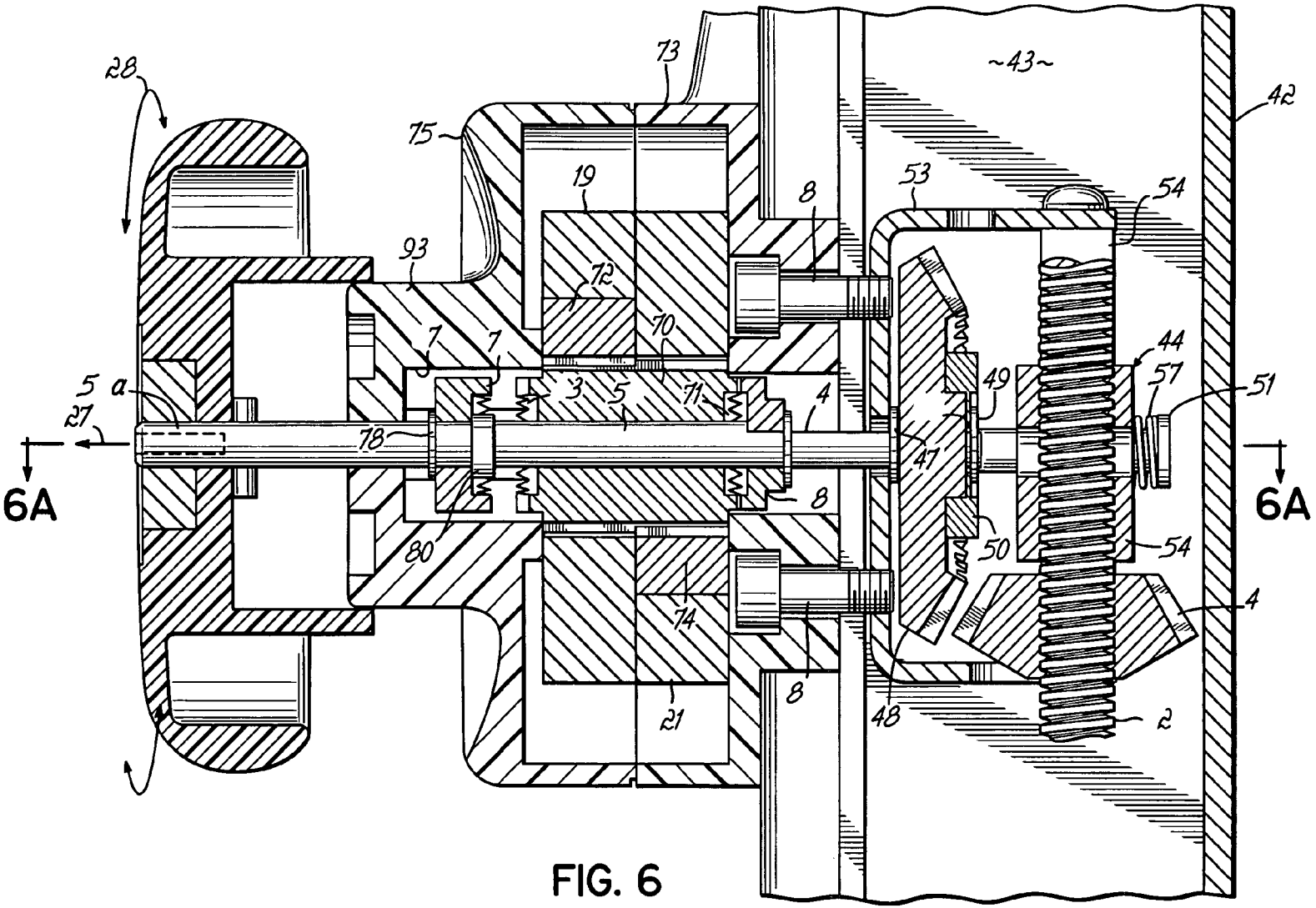
FIG. 6 is a cross-sectional view similar to FIG. 5.
Figure 6A:
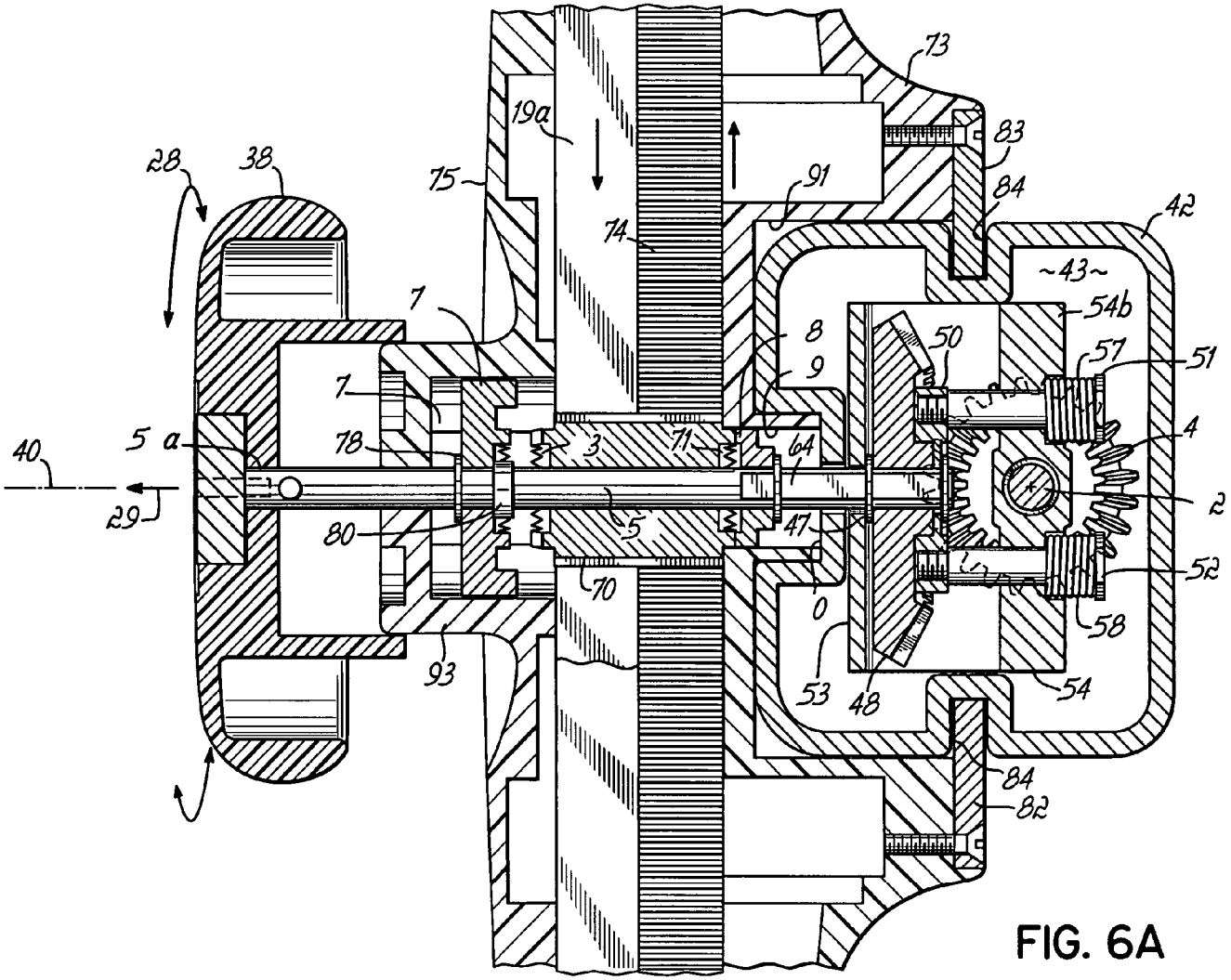
FIG. 6A is a cross-sectional view taken generally along line 6A—6A in FIG. 6.

As best shown in FIGS. 4 and 5, arm housings 73, 75 enclose many components of the dual-axis arm adjustment system and mechanically couple these components with the spine 42. The arm housings 73, 75, which are typically formed from cast aluminum, have complex interior contours that locate and stabilize the arm-width adjustment mechanism, provide mounting for the support arms 19, 21, and also guide support arms 19, 21 as the arm portions 19*b*, 21*b* translate laterally over the width travel limits. For example, the spine 42 is partially received in a vertical slot 91 (FIG. 5A) defined in the anterior side of the front arm housing 73.

The front arm housing 73 is secured with conventional fasteners 86 (FIG. 5) to the support bracket 53 of yoke assembly 44, which resides inside the spine 42. The front arm housing 73 further includes guide plates 82, 83 that ride in respective slots, of which one slot 84 is shown, running substantially the height of the spine 42. Arm housing 73 is guided for vertical movement relative to the spine 42 by the interrelationship between guide plates 82, 83 and slots 84 and is held securely to the vertical arm adjustment mechanism by the attachment with support bracket 53. An anterior side (not shown) of the front arm housing 73 is also contoured to mate closely with the spine 42.

The rear arm housing 75 also has an interior contour on an anterior surface (not shown but similar to the interior contour of the front arm housing visible in FIG. 4) that cooperates with the interior contour of the front arm housing 73 for guiding and supporting the support arms 19, 21. The support arms 19, 21 are sandwiched between the two arm housings 73, 75, which are assembled together by conventional fasteners (not shown). The support arms 19, 21 are free to travel within the assembled front and rear arm housings 73, 75, which have machined mating surfaces for close tolerance and to eliminate free play in the support arms 19, 21 over their range of width motion. The adjustment knob 38 is concentric with an annular protuberance 93 projecting from the posterior side of the rear arm housing 75, which aids in aligning and guiding the motion of adjustment knob 38.

Spine mount 14 pivotally joins the spine 42 to the seat plate 26, which serves as an anchor for the entire dual-axis arm system and connects it to the adjustable seat plate 26. The spine 42 and back assembly 13 may also be tilted forward and rearward relative to the seat plate 26 and fixed in position by a locking mechanism (not shown). The arm housing 75 includes flanges 87, 88 positioned on opposite sides of spine 42. The back support member 12 of back assembly 13 is secured with arm housing 75 with conventional fasteners 89 positioned with bushings in slotted openings defined in flanges 87, 88. The back assembly 13 travels vertically along with the support arms 19, 21 when the height of support arms 19, 21 is changed. When the fasteners 89 are loosened, the back assembly 13 is vertically movable over the extent of the slotted openings in flanges 87, 88, which permits the back assembly 13 to be moved vertically without changing the height of the support arms 19, 21. The spine 42 rides within the vertical channel 41 when the back support member 12 is moved up and down relative to the stationary seat plate 26 and arms 19, 21.

The adjustable slide attachment permits the lumbar pad 24 to be positioned relative to the support arms 19, 21 to accommodate different anatomies. For example, a tall male would have more distance from his lumbar relative to his arms at rest at his side, forearms parallel to the ground (or his lumbar relative to his elbows), than would a female with a smaller frame. This requires that the lumbar pad 24, which is attached to the back support member 12, be independently movable relative to the support arms 19, 21.

In addition to the dual-axis arm adjustment system described above, the task chair 10 further includes an arm pivot system and a multi-positional arm pad system that cooperate with the dual-axis arm adjustment system to create an effective support system that can be mounted to many existing available seat plates 26 for use with multiple different varieties of task chairs 10.

Figure 7:
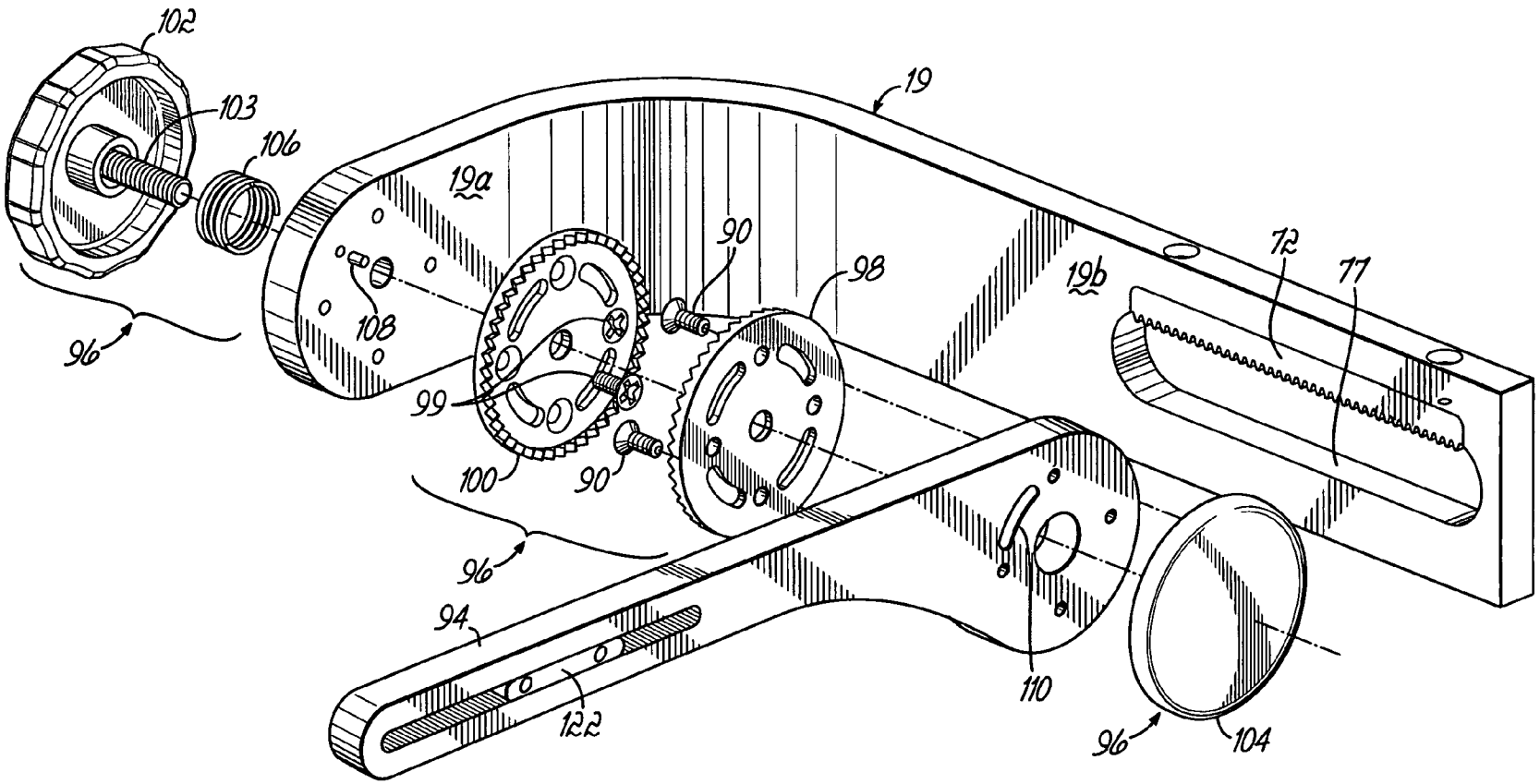
FIG. 7 is an exploded view of the arm pivot system of the task chair of FIG. 1, shown with various components removed for clarity.
Figure 8A:
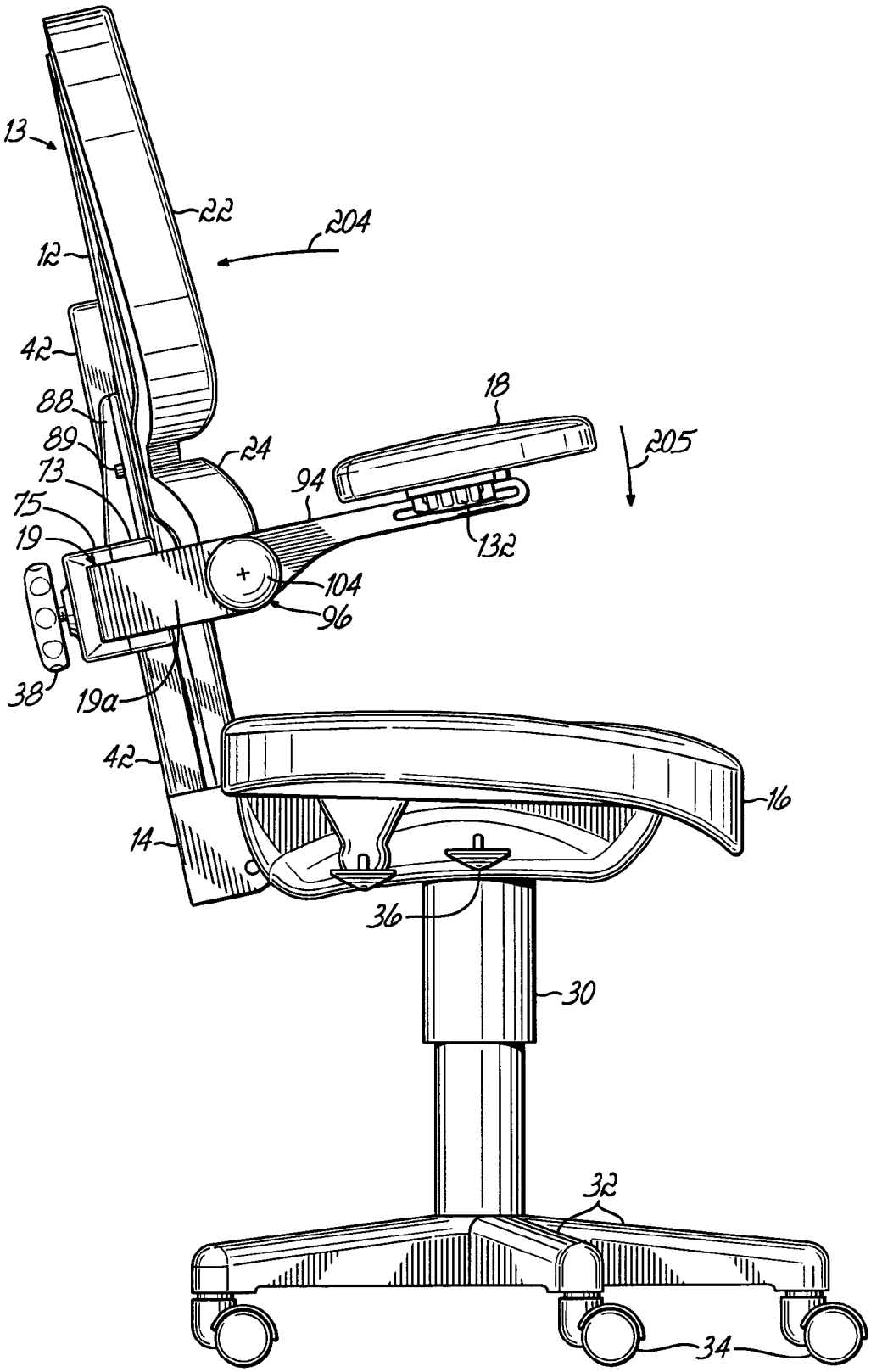
FIG. 8A is a side view of the task chair of FIG. 1 illustrating lowering the arm extensions to level the arm rests in response to a rearward tilt of the chair back.
Figure 8B:
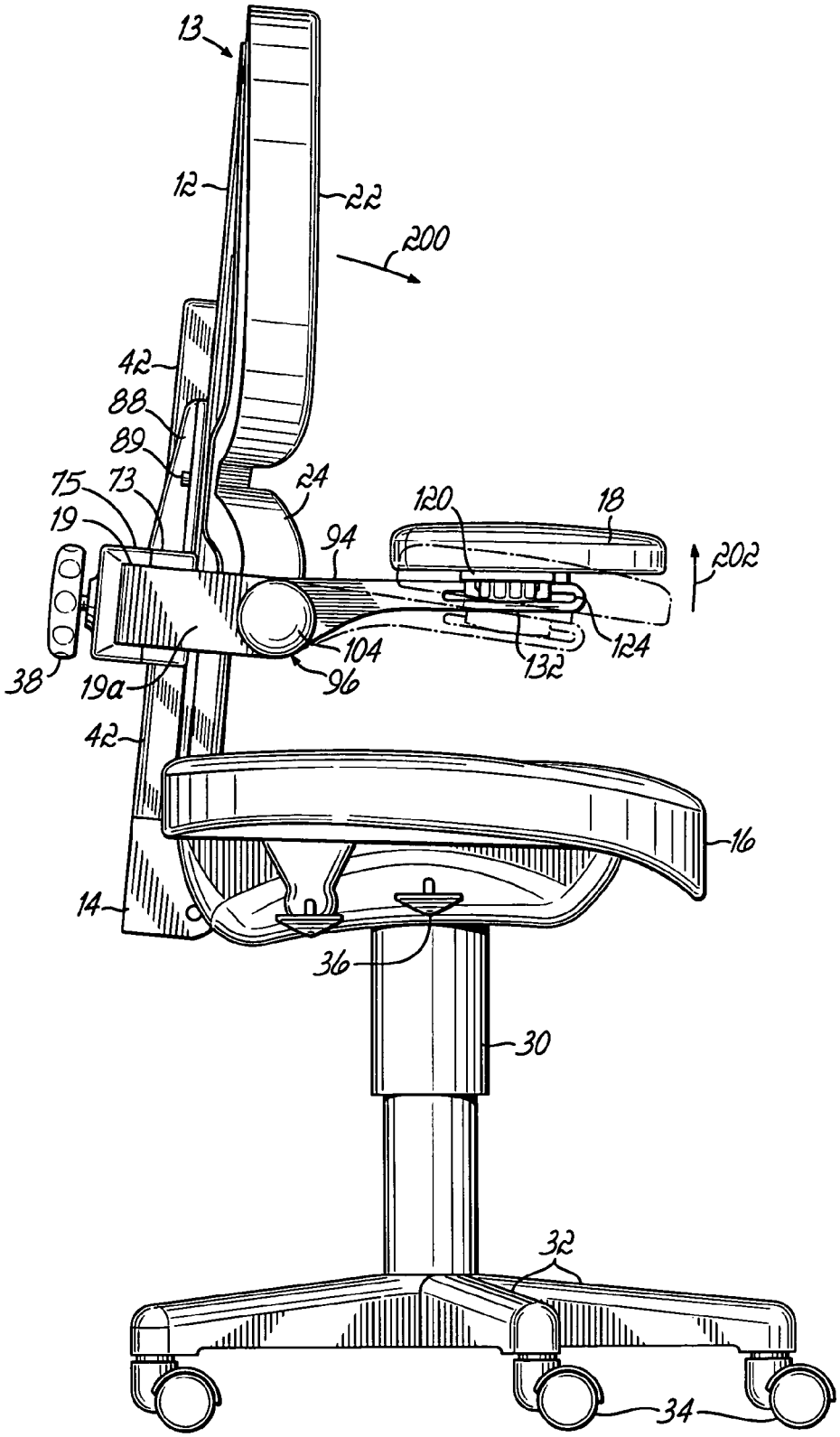
FIG. 8B is a side view similar to FIG. 8A illustrating raising the arm extensions to level the arm rests in response to a forward tilt of the chair back.
Figure 9:
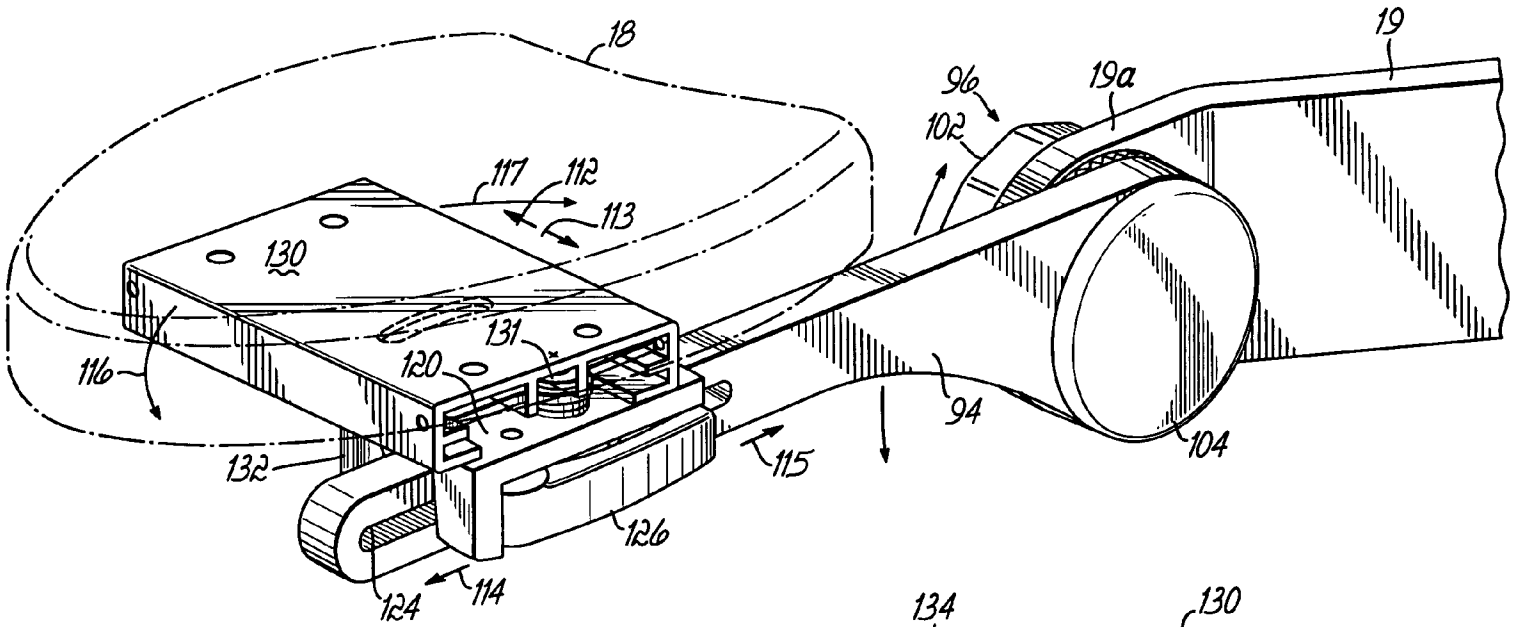
FIG. 9 is a perspective view of the multi-positional arm pad system used to mount each arm pad to one of the support arms of the task chair of FIG. 1.
Figure 10:
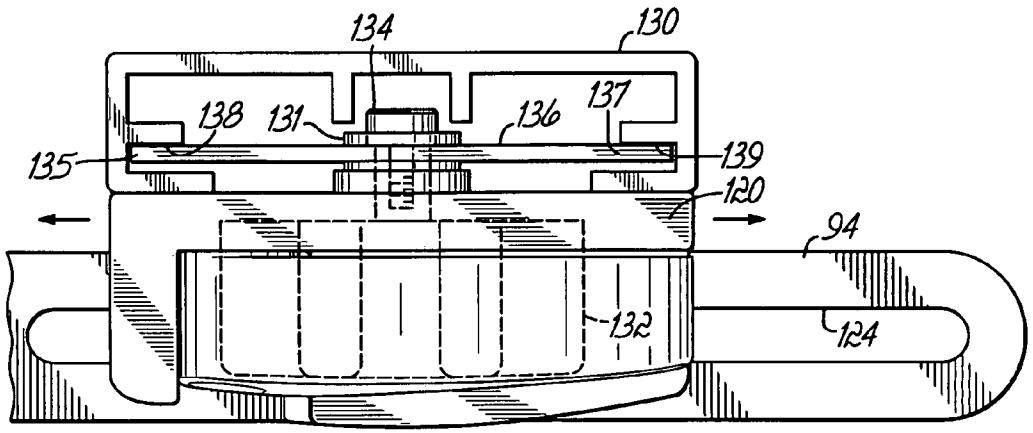
FIG. 10 is an end view of the multi-positional arm pad system of FIG. 9.
Figure 11:
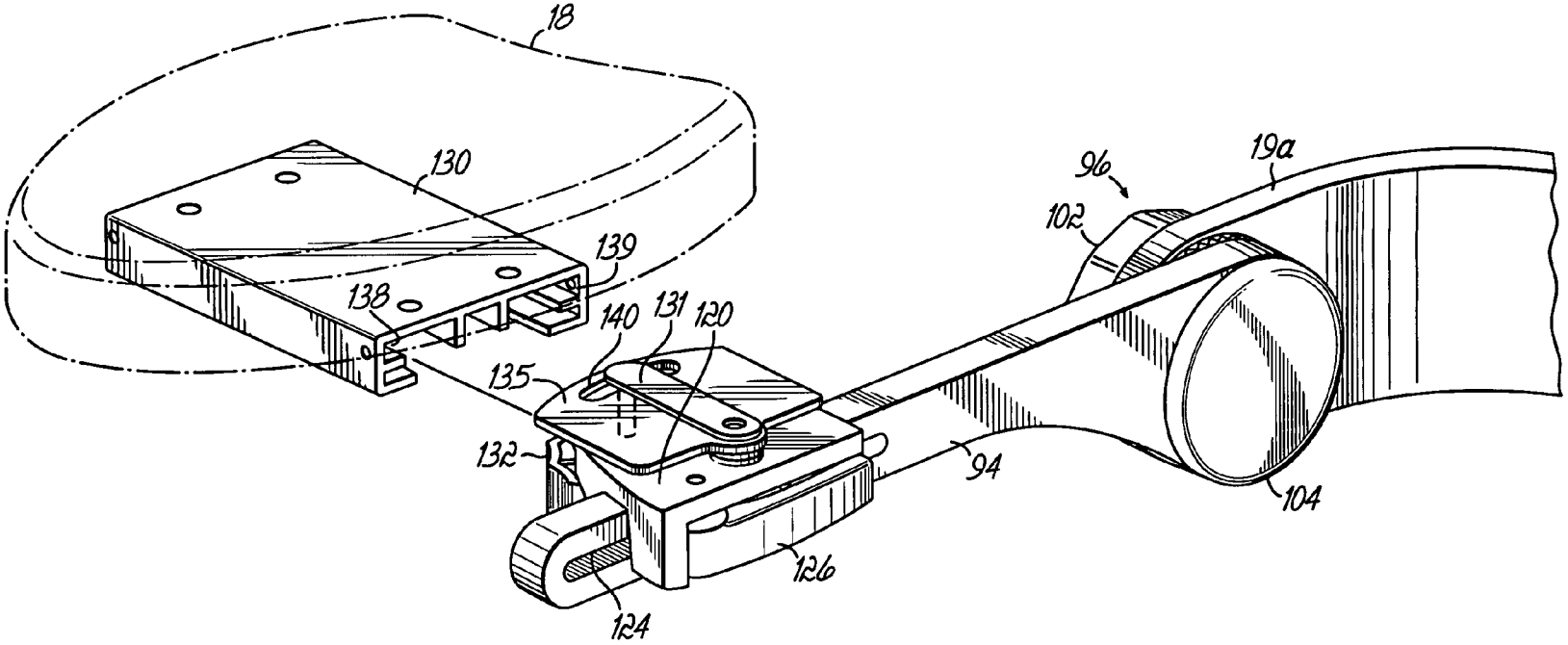
FIG. 11 is a partially disassembled view of the multi-positional arm pad system of FIG. 9.
Figure 12:
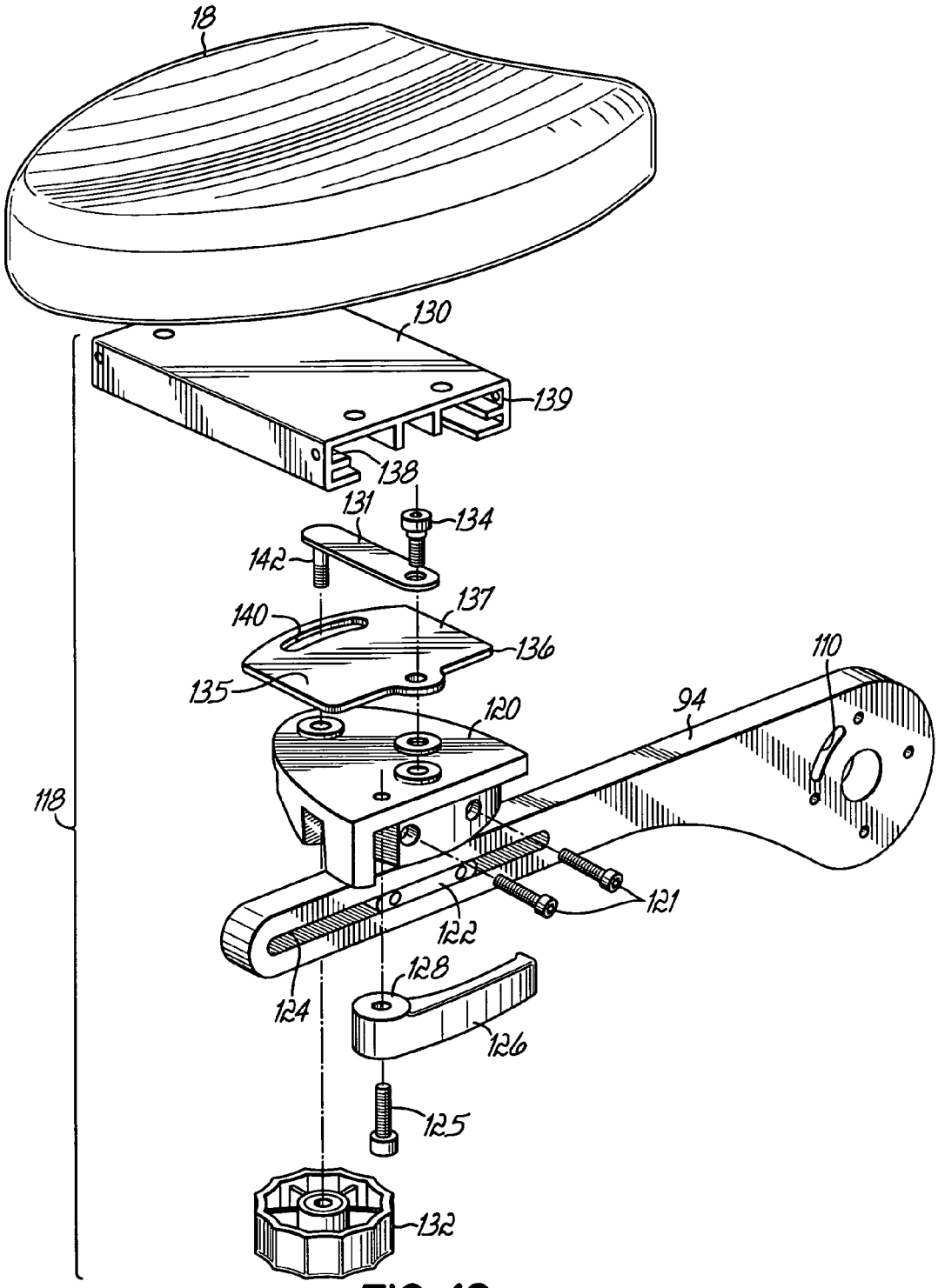
FIG. 12 is an exploded view of the multi-positional arm pad system of FIG. 9.

With reference to FIGS. 7, 8A, and 8B, support arm 19 further includes an arm portion or arm extension 94 pivotally attached to arm portion 19*a* by a pivot joint, indicated generally by reference numeral 96. The arm pivot system of task chair 10, which includes the pivot joint 96, is adapted to change the inclination of the arm extension 94 relative to the arm portion 19*a*. A second arm portion or arm extension 95, similar to arm extension 94 and visible in FIGS. 1 and 2, forms part of support arm 21 and is attached to arm portion 21*a* by a pivot joint 97, similar to pivot joint 96. Although the arm pivot system of the task chair 10 will be described with regard to support arm 19, arm extension 94, and pivot joint 96, the following description will be understood to apply equally to support arm 21, arm extension 95, and pivot joint 97.

Pivot joint 96 includes a pair of couplings 98, 100 each having circumferentially-arranged and confronting depressions and projections that are meshed. Coupling 100 is secured with the arm portion 19*a* of support arm 19 by conventional fasteners 99. Similarly, conventional fasteners 90 secure coupling 98 with arm extension 94. When the couplings 98, 100 are interrelated to mutually engage their confronting depression and projections, the inclination of the arm extension 94 is locked relative to the arm portion 19*a* and seat plate 26.

A lock knob 102 includes a threaded stud 103 that has a threaded engagement with an internally-threaded stub (not shown) of a pivot cover 104. This threaded engagement pivotally attaches arm extension 94 to the arm portion 19*a*. Lock knob 102 is adapted to be tightened to positively lock and secure the arm extension 94 against angular movement relative to the arm portion 19*a* by applying a clamping force that meshes the confronting projections of couplings 98, 100. This defines a latched condition in which the inclination of the arm extension 94 is fixed relative to arm portion 19*a* and the depressions and projections of couplings 98, 100 cannot slip relative to each other. The magnitude of the clamping force will vary depending, among other variables, on the user's adjustment of the lock knob 102.

When the lock knob 102 is loosened, the depressions and projections on couplings 98, 100 slip relative to each other when a rotational force effective to pivot arm extension 94 relative to the stationary arm portion 19*a* is applied to arm extension 94. In this unlatched condition, the arm extension 94 is rotatable relative to the arm portion 19*a* for adjusting the inclination of the arm extension 94. The pitch of the depressions and projections of couplings 98, 100 defines the angular increment over which the inclination may be changed.

A biasing member 106 applies a resilient bias that maintains pressure within the pivot joint 96, which aids the arm pivot adjustment process by keeping the couplings 98, 100 enmeshed and under pressure, so that the arm extension 94 does not lower when the lock knob 102 is loosened by an amount sufficient to permit slipping. Pressed into place on the inside of the arm extension 94 is a pivot limit pin 108 that projects into a curved slot 110 defined in arm extension 94. The arc length of the curved slot 100 limits the inclination range of the arm extension 94.

The arm pivot system permits a seated user to incline each of the arm pads 18, 20 individually to compensate for tilting of the back frame relative to the seat plate 26. The ability to change the inclination of the arm extensions 94, 95 permits the arm pads 18, 20 to remain in position with respect to a fixed plane, such as a work surface or the floor, after the back assembly 13 is tilted. Because the dual-axis arm system is affixed to the spine 42 and anchored to the seat plate 26 by spine mount 14, any adjustment of the tilt angle of the back frame will therefore tilt or adjust the pitch of the support arms 19, 21. If it is necessary to keep the arm pads 18, 20 parallel to the floor after adjusting the back frame angle, the inclination of the arm extensions 94, 95 may be readjusted to accomplish this. Of course, the arm pads 18, 20 may be inclined relative to the floor or the work surface while maintaining the angular orientation of the seat plate 26 fixed.

FIG. 8A depicts a movement sequence in which the back assembly 13 is tilted rearward, as indicated by arrow 204, and, in response, the arm extension 94 is pivoted downwardly (clockwise relative to an axis extending into and out of the plane of the page) relative to the arm portion 19*a* at pivot joint 96, as indicated by arrow 205. This serves to change the inclination of the arm pad 18 without changing the attitude of the back assembly 13. In this instance, the arm pad 18 has been leveled by the change in inclination, although the invention is not so limited.

FIG. 8B depicts a movement sequence in which the back assembly 13 is tilted forward, as indicated by arrow 200 and, in response, the arm extension 94 is pivoted upwardly (counterclockwise relative to an axis extending into and out of the plane of the page) relative to the arm portion 19*a* at pivot joint 96, as indicated by arrow 202. Again, the inclination angle of the arm pad 18 is changed without changing the attitude of the back assembly 13. Again, the arm pad 18 has been leveled, although the invention is not so limited, as the arm extension 94 and arm pad 18 may have any inclination within the permitted angular range.

With reference to FIGS. 9–12, the multi-positional arm pad system of task chair 10 facilitates adjustments of the position of arm pads 18, 20, without moving support arms 19, 21, for accommodating various sizes of seated users and numerous tasks in which the seated users may be engaged. Specifically, the arm pads 18, 20 are movable bi-directionally in a lateral direction as indicated generally by arrows 112, 113 and bi-directionally in posterior and anterior directions as indicated generally by arrows 114, 115. The arm pads 18, 20 can be rotated about a vertical axis as indicated by curved double-headed arrows 116, 117. To that end, the arm pads 18, 20 are coupled with the corresponding one of the arm extensions 94, 95 by a coupling mechanism, generally indicated by reference numeral 118, that permits movement of the arm pads 18, 20 with the two degrees of translational freedom and one degree of rotational freedom. As the coupling mechanism 118 for each of the arm pads 18, 20 is identical, the following description of coupling mechanism 118 that mounts arm pad 18 to arm extension 94 is equally applicable to the description of the coupling mechanism 118 that mounts arm pad 20 to arm extension 95.

Coupling mechanism 118 moves as an assembly relative to the arm extension 94 for adjusting the position of the arm pad 18 relative to the back cushion 22. The coupling mechanism 118 includes a mounting block or pivot plate 120 secured with conventional fasteners 121 to the arm extension 94 by a bearing block 122. The pivot plate 120 straddles the arm extension 94. The bearing block 122 rides within, and is guided by, a raceway or slot 124 defined near the free end of the arm extension 94. The length of the slot 124 determines the range of the linear travel of the coupling mechanism 118 and, hence, the range of motion of the supported arm pad 18 in the posterior/anterior direction. Attached with a conventional fastener 125 to the pivot plate 120 is a lock lever 126 that exerts pressure on an inside surface of the arm extension 94 when rotated into a locked position inline with the arm extension 94. The lock lever 126 incorporates a cam 128 that jams the travel of the arm extension 94 between the cam 128 and the pivot plate 120.

The coupling mechanism 118 further includes a pad slide 130 to which the pad 18 is mounted in a conventional manner, a lock knob lever 131, a lock knob 132 located beneath the pivot plate 120, a mounting bolt 134, and a friction or pressure plate 136, which collectively provide the lateral and rotational adjustments of the arm pad 18. The pressure plate 136 is positioned between the pivot plate 120 and the pad slide 130. Opposite side edges 135, 137 of the pressure plate 136 travel in confronting slots 138, 139 defined on the underside of the pad slide 130. The engagement between the side edges 135, 137 of pressure plate 136 and portions of the pivot plate 120 surrounding slots 138, 139 guides, regulates and locks rotation and sliding of the pad slide 130.

The pad slide 130 is rotatable about a pivot point defined by the mounting bolt 134 coupling the pressure plate 136 with the pivot plate 120. The lock knob bolt 131 projects downwardly through a curved slot 140 defined in the pressure plate 136. A threaded stud 142 on the lock knob lever 131 is engaged with an internally threaded hub of the lock knob 132. Contact between the shank of the threaded stud 142 and the opposite closed ends of curved slot 140 define rotation limits for the pad slide 130. The curvature of the curved slot 140 also defines the range of possible rotation angles for the pad 18. The pad slide 130 and the pressure plate 136 collectively rotate about the mounting bolt 134 within the defined rotation limits.

The lock knob 132, when tightened, applies a clamping force to the lock knob lever 131 that pulls the pad slide 130 and the pressure plate 136 toward the pivot plate 120. The clamping force applied by the lock knob 132 secures and locks all of the moving parts in a fashion that simultaneously inhibits lateral sliding and rotation of the arm pad 18. The magnitude of the clamping force will vary depending on the user's adjustment of the lock knob 132.

Figures 13A, 13B:
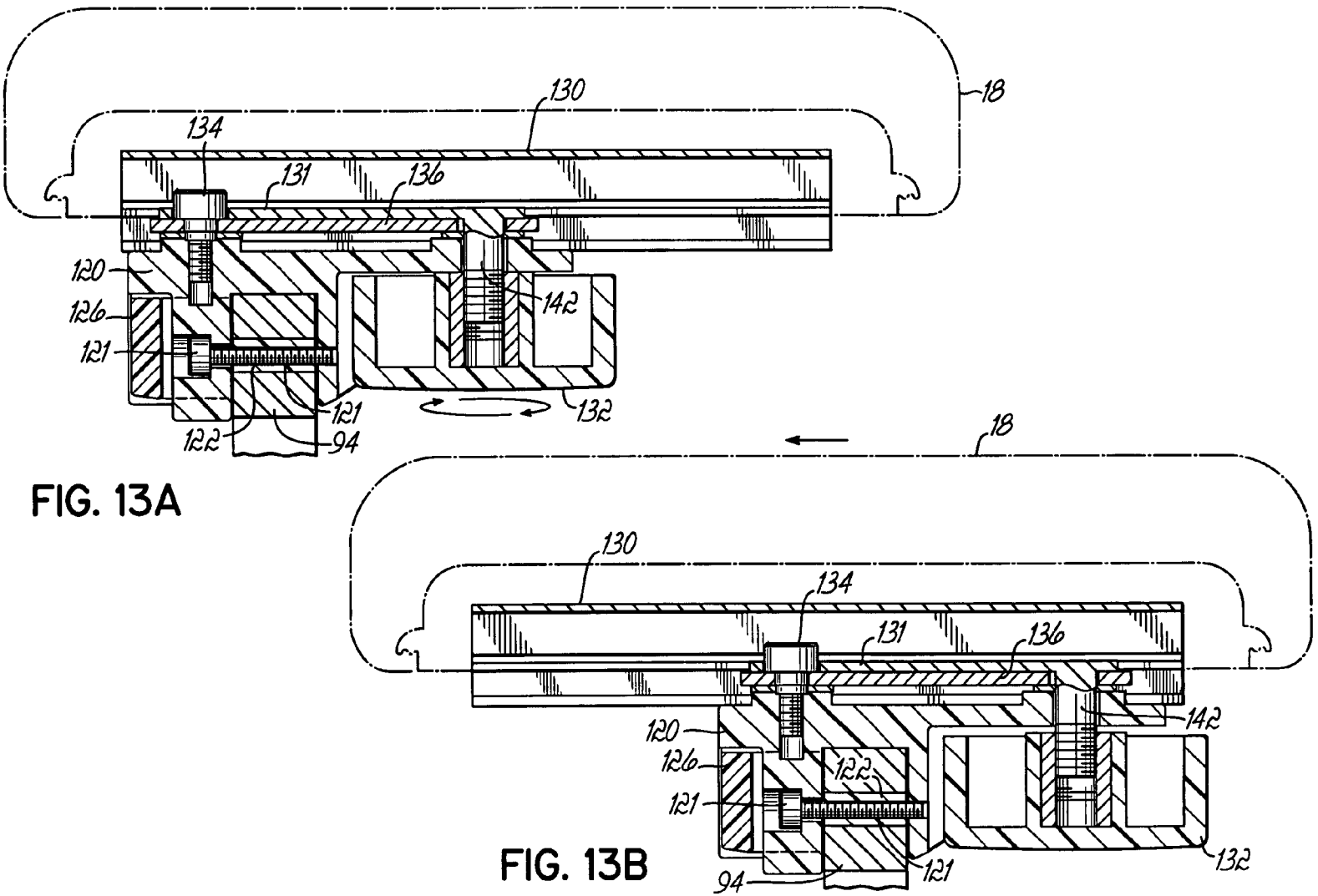
FIG. 13A is a cross-sectional view taken generally along the lateral midline of FIG. 9.
FIG. 13B is a cross-sectional view similar to FIG. 13A in which the pad slide has been translated in one direction.

In use and with reference to FIGS. 13A and 13B, the pad slide 130 is depicted in two separate laterally-translated positions relative to the arm extension 94. The pad slide 130 is clamped in FIG. 13A at a first lateral position and is moved laterally in FIG. 13B to a second lateral position. Lock knob 132 is loosened on threaded stud 142 to reduce the downward clamping force applied by the side edges 135, 137 of pressure plate 136 to the pad slide 130. This provides the condition of FIG. 13B in which enough of the clamping force is removed to allow the pad slide 130 to move laterally. A lateral force applied to the pad 18 causes the side edges 135, 137 of the pressure plate 136 to slide along slots 138, 139 of the pad slide 130 in a direction consistent with the direction of the lateral force. After the second lateral position is established, the lock knob 132 is tightened to apply a clamping force to the pressure plate 136 sufficient to prevent inadvertent lateral movement of the pad slide 130. Pad 20 is repositioned relative to arm extension 95 in a similar manner.

The pad slide 130 may also be rotated about an axis defined by mounting bolt 134 relative to the pivot plate 120. The rotational orientation of pad slide 130 is adjustable when lock knob 132 is loosened and is locked by the clamping force applied by the tightened lock knob 132. The coupling mechanism 118 may also be translated along the length of slot 124. A clamping force applied by the cam 128 of lock lever 126 is used to lock the position of the coupling mechanism 118 after this positional adjustment.

Figure 14:
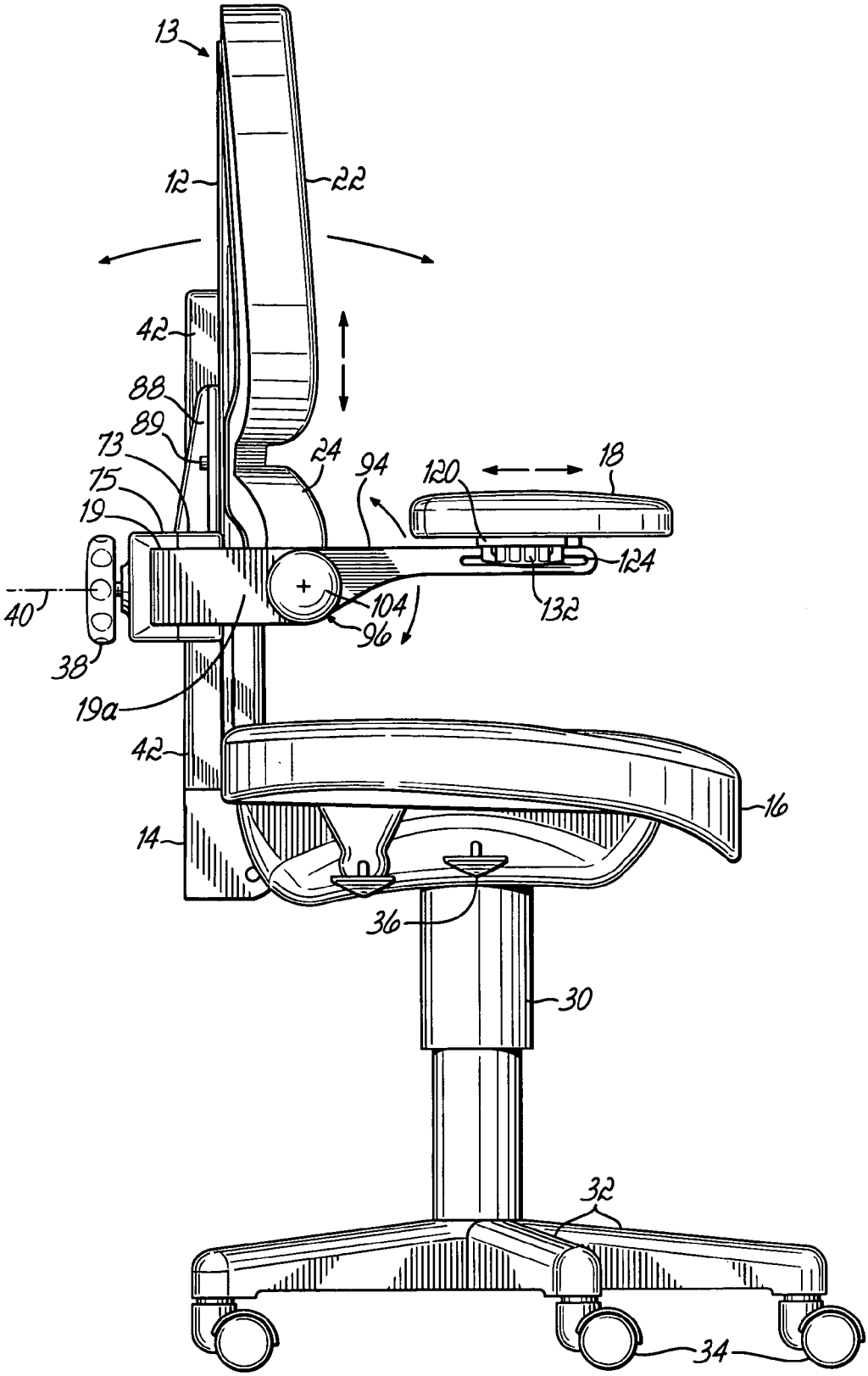
FIG. 14 is a side view similar to FIG. 8A illustrating the various positional adjustments among the components of the task chair of FIG. 1.

With reference to FIG. 14 in which like reference numerals refer to like features in FIGS. 1–13 and by way of summary, the task chair 10 features multiple degrees of adjustability for the location of the arm pads 18, 20. In particular, the arm pads 18, 20 may be moved vertically relative to the seat cushion 16 by turning adjustment knob 38 and may be moved into and out of the plane of the page by rotating adjustment knob 38 while applying an outward axial force along axis 40. Furthermore, the inclination of the arm extensions 94, 95 may be adjusted for changing the orientation of the arm pads 18, 20 relative to the seat cushion 16. The arm pads 18, 20 are adjustable along a portion of the length of the arm extensions 94, 95.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicants' general inventive concept. The scope of the invention itself should only be defined by the appended claims.

We claim:

1. A task chair comprising:

a seat plate;

a spine projecting upwardly from said seat plate;

a carriage mounted for movement relative to said spine;

a pair of spaced-apart support arms supported by said carriage, said support arms flanking said seat plate and separated vertically from the seat plate;

a first adjustment mechanism coupled with said carriage, said first adjustment mechanism operative for moving said carriage relative to said spine, and said support arms moving with said carriage up and down relative to said seat plate;

a second adjustment mechanism operatively coupled with said carriage for moving said support arms laterally relative to said seat plate; and an adjustment element operatively coupled with said first and second adjustment mechanisms, said adjustment element adapted to independently operate said first and said second adjustment mechanisms.

2. The task chair of claim 1 wherein said first adjustment mechanism includes a lead screw fixed to said carriage, and a gear train selectively coupling said adjustment element with said lead screw, said gear train converting rotation of said adjustment element to linear motion of said carriage relative to said spine.

3. The task chair of claim 2 wherein said gear train includes a driver gear coupled with said adjustment element and a driven gear coupled for rotation with said lead screw, said driver gear capable of being enmeshed with said driven gear so that rotation of said driver gear by said adjustment element causes rotation of said driven gear relative to said lead screw.

4. The task chair of claim 3 wherein said adjustment element includes a rotatable driven shaft coupled with said driver gear, said driven shaft configured to move said driver gear relative to said driven gear for selectively enmeshing said driver gear with said driven gear.

5. The task chair of claim 1 wherein said second adjustment mechanism includes a drive gear selectively coupled with said adjustment element, and each of said support arms includes a rack engaged for linear motion with said drive gear, said adjustment element capable of rotating said drive gear to cause movement of said support arms laterally relative to said seat plate.

6. The task chair of claim 5 wherein each of said racks includes a series of rack teeth arranged along a surface of a corresponding one of said support arms, and said drive gear has gear teeth engaged with said rack teeth.

7. The task chair of claim 6 wherein said drive gear is positioned between said racks with said rack teeth of each of said racks engaged with a different portion of said gear teeth of said drive gear so that rotation of said drive gear causes said support arms to translate in opposite lateral directions relative to said seat plate.

8. The task chair of claim 7 wherein said drive gear is configured to rotate in a first direction to decrease the separation between said support arms and in a second direction to increase the separation between said support arms.

9. The task chair of claim 5 wherein said drive element includes a rotatable driven shaft and a first coupling coupled for rotation with said drive shaft, and said drive gear includes a second coupling coupled for rotation with said drive gear, said first and second couplings adapted to be selectively engaged for coupling said drive gear with said driven shaft.

10. The task chair of claim 9 wherein said driven shaft is configured to move said first coupling relative to said second coupling for engaging and disengaging said drive gear and said driven shaft.

11. The task chair of claim 9 wherein said second adjustment mechanism further includes a third coupling having a fixed angular position, and said drive gear includes a second coupling adapted to be selectively coupled with said first coupling for engaging said drive gear with said rotatable driven shaft, said driven shaft configured to move said first coupling relative to said second coupling for engaging and disengaging said driver gear with said driven gear.

12. The task chair of claim 1 wherein said first adjustment mechanism and said adjustment element are mounted to said carriage.

13. A task chair comprising:

a seat plate;

a spine projecting upwardly from said seat plate; and a pair of spaced-apart support arms supported by said spine, said support arms flanking said seat plate in a plane separated vertically from the seat plate, each of said support arms including a first arm portion coupled with said spine, a second arm portion, and a pivot joint rotatably coupling said first and second arm portions, said pivot joint allowing said second arm portion to be inclined relative to said first arm portion for adjusting the inclination of said second arm portion relative to said seat plate.

14. The task chair of claim 13 wherein said pivot joint further includes a pair of couplings and an adjustment element, said couplings having a latched condition in which the inclination of said second arm portion relative to said first arm portion is fixed and an unlatched condition in which said second arm portion is rotatable relative to the first arm portion for adjusting the inclination of said second arm portion.

15. The task chair of claim 14 wherein said pivot joint further includes an adjustment element configured to apply a first force directed to engage said couplings for providing said latched condition and to apply a lesser second force providing said latched condition.

16. The task chair of claim 14 further comprising:

a biasing member configured to bias said couplings together in said unlatched condition.

17. A task chair comprising:

a seat plate;

a spine projecting upwardly from said seat plate;

a pair of spaced-apart support arms supported by said spine, said support arms flanking said seat plate and separated vertically from the seat plate;

a pair of arm pads;

a pair of pad slides each carrying one of the arm pads; and a pair of adjustment mechanisms each coupling a corresponding one of said pad slides with a corresponding one of said support arms, each of said adjustment mechanisms including a first member mounted to the corresponding one of said support arms for movement in a first direction, and a second member mounted for rotation relative to said first member about an axis of rotation normal to said first direction, said second member carrying the corresponding one of said pad slides so that said pad slide rotates simultaneously with said second member.

18. The task chair of claim 17 wherein said pad slide is mounted to said second member for movement in a second direction coplanar with said first direction.

19. The task chair of claim 18 wherein said second member includes opposite first and second side edges, and said pad slide includes confronting first and second slots arranged to receive a corresponding one of said first and second side edges, said first and second slots oriented so that movement of said first and second side edges within said first and second slots constrains movement of said pad slide in said second direction.

20. The task chair of claim 19 wherein said adjustment mechanism includes a locking element adapted to selectively move said second member relative to said pad slide such that said first and second side edges apply a force against said first and second slots effective to prevent movement in said second direction.

21. The task chair of claim 18 wherein said adjustment mechanism includes a locking element operatively coupled with said second member for locking said pad slide against movement in said second direction and said second member against rotation relative to said first member.

22. The task chair of claim 17 wherein each of said adjustment mechanisms further includes a locking lever configured to lock said first member against movement in said first direction.

23. The task chair of claim 22 wherein each of said support arms includes a raceway, and said adjustment mechanism further includes a slide bearing positioned within said raceway of the corresponding one of said support arms, said slide member coupled with said first member so that movement of said slide bearing within said raceway constrains movement of said first member in said first direction.

* * * * *